United States Patent [19]

Gunn et al.

[11] Patent Number: 4,963,118

[45] Date of Patent: Oct. 16, 1990

[54] METHOD AND APPARATUS FOR COIN SORTING AND COUNTING

[75] Inventors: William L. Gunn, Atlanta; William D. Heath, Jr., Breman; John C. Mantovani, Lilburn, all of Ga.

[73] Assignee: Brink's Incorporated, Darien, Conn.

[21] Appl. No.: 232,898

[22] Filed: Aug. 16, 1988

[51] Int. Cl.[5] ..... G07D 3/16

[52] U.S. Cl. ..... 453/3; 194/317; 324/234; 336/182

[58] Field of Search ..... 194/317, 318, 319; 209/567, 570; 336/182, 183, 136; 324/202, 228, 234; 453/3

[56] References Cited

U.S. PATENT DOCUMENTS

| | | | |
|---|---|---|---|
| 3,061,774 | 10/1962 | Ryan | 324/234 |
| 3,594,671 | 7/1971 | Frenkel | 336/183 X |
| 3,751,871 | 8/1973 | Hull et al. | 53/397 |
| 4,086,527 | 4/1978 | Cadot | 194/318 X |
| 4,462,513 | 7/1984 | Dean et al. | 194/318 |
| 4,509,633 | 4/1985 | Chow | 194/334 |
| 4,509,633 | 4/1985 | Chow | 194/334 |
| 4,558,295 | 12/1985 | Olsted et al. | 336/136 X |

FOREIGN PATENT DOCUMENTS 2135095A 8/1984 United Kingdom .

OTHER PUBLICATIONS

Brochure for case "Titan 24 08" marks as embodiment of Ref. AL.

*Primary Examiner*—F. J. Bartuska

*Attorney, Agent, or Firm*—Jones, Askew & Lunsford

[57] ABSTRACT

This is a coin sorting and counting apparatus for providing very accurate high throughput processing of heterogeneous coin mixtures. A rotating drum having parallel annular channels, each of which has equally spaced counterbores located around it is rotated within a vacuum plenum. A novel sensor coil constructed as a balanced transformer of four coils having rectangular geometries is used, in conjunction with a dual frequency excitation signal, to detect at least three electronic signatures for each coin, the signatures are detected by separating the frequency components in the output of the sensor coil and obtaining a peak value for the excursion of the high frequency response caused by passage of the coin, and width values corresponding to the time the excursion of the signal was above a predetermined threshold for both the high and low frequency responsive channels. Based on the denomination determined, appropriate signals are inserted into a coin ejection memory queue which is shifted in synchronism with rotation of the drum. The memory queue is constructed so that an appropriate air valve will be activated when the detected coin is over an appropriate one of a plurality of coin receiving stations. A set of lag sensors are used downstream from the coin ejecting air valves to confirm proper ejection of the coins. Separate calibration values for the signature signals are acquired and saved for each counterbore location to offset the effects of variations in circuitry on a channel-by-channel basis and slight mechanical irregularities in movement of the counterbores past the sensor array.

21 Claims, 11 Drawing Sheets

TO NAND GATE 186
HIGH FREQ. PEAK TO A to D 177 (FIG 8C)
LOW FREQ. PEAK TO A to D 177 (FIG 8C)

LAG OUTPUT
TO NAND GATE 187

PEAK HOLD
CLEAR
FROM CONTROL LOGIC 210 (FIG 8C)
LPF
FULL WAVE RECTIFIER
200 KHz NOTCH
HPF 52 KHz
LPF 2.6 KHz
ANALOG SWITCH
CNTRL
$V_{REF}$
179
176
175
178
180
181
241
242
240
239
238
237
236
235
231
232
230
127
169
81
126
170
171
249
250
251
252
255
256
257
245
246
247
248
260
261
262
265
259
258
169'
81'

SENSOR OUTPUT SETS 1 BIT

| | Q | N | P | D |
|---|---|---|---|---|
| $N_4$ | Q | | | |
| $N_3$ | | N | | |
| $N_2$ | | | P | |
| $N_1$ | | | | D |
| $N_0$ | | | | |

} READ ALL VALUES HERE

| | Q | N | P | D | |
|---|---|---|---|---|---|
| $N_4$ | 1 | | | | $T_1$ |
| $N_3$ | 1 | 0 | | | |
| $N_2$ | X | X | 0 | | |
| $N_1$ | X | X | X | 0 | |
| $N_0$ | X | X | X | X | READ |

| | Q | N | P | D | |
|---|---|---|---|---|---|
| $N_4$ | 0 | | | | $T_2$ |
| $N_3$ | 1 | 0 | | | |
| $N_2$ | X | 0 | 1 | | |
| $N_1$ | X | X | 0 | 0 | |
| $N_0$ | X | X | X | 0 | READ |

| | Q | N | P | D | |
|---|---|---|---|---|---|
| $N_4$ | | | | | $T_3$ |
| $N_3$ | 0 | | | | |
| $N_2$ | 1 | 0 | | | |
| $N_1$ | X | 0 | 1 | | |
| $N_0$ | X | X | 0 | 0 | READ |

| | Q | N | P | D | |
|---|---|---|---|---|---|
| $N_4$ | | | | | $T_4$ |
| $N_3$ | | | | | |
| $N_2$ | 0 | | | | |
| $N_1$ | 1 | 0 | | | |
| $N_0$ | X | 0 | 1 | | READ |

| | Q | N | P | D | |
|---|---|---|---|---|---|
| $N_4$ | | | | | $T_5$ |
| $N_3$ | | | | | |
| $N_2$ | | | | | |
| $N_1$ | 0 | | | | |
| $N_0$ | 1 | 0 | | | READ |

METHOD AND APPARATUS FOR COIN SORTING AND COUNTING

TECHNICAL FIELD

The present invention relates generally to the fields of coin validation and identification and coin sorting and counting and in particular includes an improved electronic coin sorting apparatus with novel and improved coin validation and identification apparatus which also has utility in the environment of a coin validator.

BACKGROUND OF THE INVENTION

In recent years, significant advances have been made in the art of coin identification and validation, particularly with respect to electronic validators. The basic principles of coin identification and validation are well known. In the early days of coin operated vending machines, mechanical devices were used to attempt to identify and validate coins deposited into the machines. Some of the earliest machines simply accepted one denomination of coin and mechanical sizing apparatus was used to determine if the inserted piece was the proper size for that coin denomination. Naturally, such devices were susceptible to the use of slugs.

Later, mechanical devices based on fundamental kinematics were used to bounce deposited pieces off surfaces of predetermined resiliencies in order to validate coin mass. The normal discrepancy encountered between the mass of a slug of a given physical size and a coin would cause the coin to bounce through a path through which it could be tallied, and cause the slugs to bounce to a coin return path.

Beginning essentially with the invention of the transistor, electronic devices for validating coins started to be used. This trend continued, and expanded greatly as the circuit density of integrated circuits has increased through the 1970's and 1980's. In today's world, all electronic validators accepting multiple denominations of coins are in common use.

One of the older principles of electronic coin validation is determination of the metallic content of a coin piece by detecting its contribution to the inductance of an excited coil which is placed physically near the coin during its travel through the validator. Under these circumstances, the coin is acting as a metallic core to the coil and effects the overall terminal inductance seen at the terminals of the particular coil. Measuring a particular electronic parameter, such as the magnitude of an alternating current signal of a particular frequency determines the inductance of the coil/coin combination in a manner which gives information with respect to the metallic content of the coin.

Similarly, various electronic devices for determining coin diameter have been used, many of which employ sequentially masked and unmasked photodetectors.

An example of a modern all electronic validator is shown in U.S. Pat. No. 4,509,633 to Chow. The Chow apparatus employs sets of photodetectors having beams which cut across the coin path through the validator and appropriate timing circuitry to determine the diameter of a passing coin. An excited coil is used to detect the metallic content. Look-up table values for combinations of coil signal and diameter for a predefined set of valid coins are employed in order to accept or reject any coin piece inserted into the validator.

Another example of a coin discriminator or identifier is shown in U.K. Patent Application No. 2,135,905A to Leonard et al. The Leonard apparatus uses successively applied rectangular pulses to pairs of coils adjacent the coin path in order to determine both metallic content and diameter. The fundamental principle of the Leonard apparatus is to excite one of the coils in question which induces eddy currents in the coin. Once the excitation (a rectangular pulse) is removed, the decay of the eddy currents is measured. Additionally, the Leonard coin discriminator employs multiple coils of varying diameters. The eddy currents induced in the coils of differing diameters will produce different coil outputs as the eddy currents decay. In this manner, a sequence of critically timed rectangular excitation pulses applied to one coil, combined with measurement of the decay characteristics of the eddy currents as detected by another coil, is employed to use inductive coils to ascertain coin diameter as well as indications of metallic content. The approximately exponential decay rate of the current characteristic induced in the detector coil by the eddy currents is used to classify the coin. Again, look-up tables of known ranges of values for coins of specific denominations are employed to determine the validity and denomination of each piece passing through the system.

As is known to those skilled in the art, the primary purpose of coin discrimination apparatus and typical coin validators, used in an environment such as vending machines, is to determine the validity and denomination of the coin so that the total amount of money deposited at any given time may be calculated to see if the machine should vend its product or service. In most vending machine enviroments, all of the coins deposited are collected in a common collection box. It is well known that once the coin discrimination apparatus is operated, it is possible to use the output signals from the discriminator to physically sort coins into a plurality of receptacles, each of which is dedicated to receipt of coins of a particular denomination. Therefore, the coin discriminating apparatus of coin validators and sorters serve the common function of discriminating between valid and invalid coins, as well as determining the denomination of those determined to be valid.

The substantial technical problem encountered in making the transition from coin validation functions to coin sorting functions is the problem of throughput, or processing a sufficient number of coins per unit time to constitute an efficient sorting process. Coin validating apparatus, by its nature, tends to be serial in nature, thus it is normally designed in an environment where coins are processed one at a time.

Naturally, in the prior art there has been need to sort the heterogeneous collection of coin denominations which appear in the collection boxes of vending machines and other devices of the type described above. Usually, as the coins travel through the stream of commerce, they are packaged together in convenient collections of like denominations, such as the well known two dollar roll of nickels, five dollar roll of dimes, ten dollar roll of quarters, etc. used in the United States. These are distributed to business establishments to be used in making change. Much of the change finds its way to vending machines, toll collection points, and the like where, as described hereinabove, it is mixed in collection boxes with coins of various denominations.

Banking operations have a need to both count and sort large collections of coinage which arrives at various locations in a heterogeneous mixture of denominations. Other businesses, such as operation of pay telephones, parking meters, vending machines and others have large volumes of heterogeneous coin mixtures to handle.

Most prior art coin sorting devices are mechanical sizing machines. In other words, they assume the essential validity of the coins at the input and use varying mechanical devices to sort the coins by size and thus by denomination. One example of such a prior art machine are the well known shaker sorters which use trays perforated with holes of successively decreasing diameters. Coins will be provided over the shaker trays at an approximately predetermined rate per unit time and they are shaken as the coins travel down the path of the trays. The first set of perforations will be sized to pass the smallest diameter coin to block the passage of larger coins. A sufficient distance down stream from the first set of holes will be a second set of holes sized to pass the next diameter coin in the denomination set and used to block the others.

The flow in coins per unit time over the perforated trays and the number of perforations is empirically determined so that a very high percentage of the coins of each denomination will pass through the appropriate holes into collection bins dedicated to each denomination.

Additionally, rail sorters are well known to those skilled in the art in which a pair of diverging coin carriers are used such that the coins will drop when their underlying support gives away as a result of the spread of the rails as coins are passed over them. Also, coin sorters constructed with a spinning disk onto which the coins are dropped are known. On such devices, centrifugal force slings the coins out toward the outer periphery of the disk and various size exit channels are provided to sort the coins by size.

Once the coins have been sorted, there are several well known devices for repackaging them so that they once again appear in convenient rolls or other collections containing a predetermined number of coins. One example of such a coin packaging machine is shown in U.S. Pat. No. 3,707,244 and 3,751,871, to Hull et al. which are assigned to the assignee of the present invention. In this apparatus, a large number of coins of the same denomination are inserted into the interior of a rotating drum surrounded by a vacuum plenum. The drum is perforated with a plurality of counterbore locations into which the partial vacuum within the vacuum plenum sucks the coins as the drum is rotated. The counterbore locations rotate past inductive coin sensors which, when a coin is detected, activates an air jet to knock the coin into a coin chutes. In the Hull et al. patent, the output of the coin chutes includes apparatus for stacking the coins, ultimately for packaging in collections of predetermined numbers of coins of the same denomination. Additionally, the apparatus counts the number of coins detected and forced out of the counterbore locations into the stacking chutes. In this way, the total value of a large collection of coins of the same denomination can be ascertained as it is packaged.

A principal advantage of the coin packaging apparatus shown in the Hull '871 patents is its high throughput, i.e. the large number of coins per unit time that it can process and package.

It has come to the attention of the inventors of the present invention that it appears that a coin discrimination system described in the Leonard et al. U.K. application has been commercially exploited in the United Kingdom in a machine marketed under the name Titan 2408 Cash and Security Equipment Limited of Saint Albans in the U.K. It is not known to the inventors of the present invention whether this apparatus constitutes prior art to the present invention. The Titan coin sorting apparatus uses a rotating plate with a plurality of receptacles disposed about the periphery. It appears that coins are introduced toward the center of the rotating disk and move out to the edge and into the counterbores under the influence of centripetal force. They apparently pass over coin discriminating apparatus of the type described in the Leonard patent and some form of computing device keeps track of the denominations present at each location which are ultimately ejected when the coin is in registration with an appropriate output conduit for its denomination.

While little information is available to the inventors on the Titan 2408 machine, it has an apparent drawback that it processes coins only serially since the coins are only identified as they are carried in a receptacle along the outer periphery of the rotating disk. A technical specification for the machine which, on its face, is printed by the manufacturer, specifies 520 coins per minute as the throughput on the apparatus.

Since it seems apparent that the Titan 2408 uses a microprocessor or microcomputer in its operation, it will be apparent to those skilled that the cost of the electronics and denomination specific conduits are all provided for a single rotating disk in this machine. There is no apparent practical way to duplicate the number of disks in a practical embodiment of this type of machine in order to increase the throughput.

In this connection, it should be noted that the described sequence of excitation and detection in the Leonard U.K. patent shows a successive sequence of excitation pulses for which the timing is critical and which must be serially applied to each coin. Thus, it is conceivable, although the inventors do not know if this is the case, that the throughput of a machine such as the Titan 2408 is running at its maximum operating speed, given the signal generation and detection requirements of the Leonard coin identification scheme and the processing power of a typical high speed microprocessor.

Therefore, there is a need in the art for a dependable electronic coin sorting apparatus having a significantly higher throughput than that of a single disk machine such as the Titan 2408. Additionally, it is critical that such a machine be able to not only dependably sort, but to dependably count the amount of money sorted since many applications of such machines are on a service basis, i.e. the operator of the sorter is performing a sorting and counting service for the owner of the money. A typical example is the service of sorting coins from pay telephones. Given the significant throughput of a packaging apparatus such as that disclosed in U.S. Pat. No. 3,751,871 to Hull, it is desirable to use a structure and coin handling apparatus of the type disclosed in Hull '871 in a dependable coin sorting arrangement.

As noted hereinabove, the discriminator of the type shown in the Leonard U.K. patent requires multiple coils in order to identify coin size. The counterbores in the rotating interior drum of the coin packaging apparatus shown in the Hull patent must be sized so that they can accept the largest size coin of interest, normally a United States quarter, in the preferred embodiment. Under these circumstances, when smaller diameters coins are lodged in the counterbore, it was a rather trivial problem to detect the presence of some coin in one of the counterbores when the machine is fed with input consisting solely of coins of a single denomination. However, if a heterogeneous collection of coin denominations is fed into the Hull apparatus, the identification problem is exacerbated by the uncertainty of the particular portion of the counterbore which will be occupied by a given coin, such as a dime or a penny, of a smaller diameter than the diameter of the largest coin of interest.

It is extremely desirable in the art to be able to process a large number of coins through a coin discriminating apparatus in a manner which can detect a coin signature identifying its size and metallic content (and thus its denomination) using only electronic coils. Generally, this goal is achieved by the apparatus of the Leonard discriminator. However, the Leonard discriminator requires precise calibration and detection of small differences between similarly shaped exponential decay curves resulting from the eddy current decay described hereinabove in order to discriminate among coins. The apparatus of Leonard must provide a precision time base and detect slight differences on the order of microseconds in the exponential decay characteristics of the detected eddy currents. This leads to a relatively complex apparatus requiring precise components for establishing the time base and to more stringent calibration requirements. Additionally, the apparatus must rotate slowly enough such that a given coin covers the necessary sequence of coils for a sufficient period of time to allow the entire sequence of pulses described in the Leonard apparatus to be applied by the coin as it passes over the coils. Therefore, there is a need in the art for an all electronic coin sorter which can discriminate coins based solely on coil outputs, but which device employs a much simpler signature detection scheme that does not require the precise timing of pulses and detection of exponential decay characteristics.

SUMMARY OF THE PRESENT INVENTION

The present invention fulfills the above described need in the prior art by providing a coin discrimination apparatus which is practically usable in the environment of a high throughput coin handling machine such as that shown in the above referenced Hull patent. Because of the use of a rotating drum within the vacuum plenum, it would be very difficult to dispose coils on opposite sides of a coin in this type of handling apparatus. Therefore, it is necessary to be able to test for coin signatures solely by the use of coils positioned near the counterbores, but only on one side of the coin.

Additionally, it is impractical, because the counterbores are disposed along the interior of a plurality of annular rings which form the rotating drum, to use photodetector devices and the like to measure coin diameter.

Additionally, a significant problem was encountered by the inventors of the present invention in addressing the question of how to detect a valid coin diameter signature for relatively small coins lying in a relatively large counterbore, such as the case with United States dimes seated in a counterbore sized to handle coins up to the size of United States quarters. This lead to the need to invent an entirely new coin discriminating method and apparatus which is practically usable in the environment of a Hull type processing device. Based on the results achieved by the present invention, the inventors believe that an enlargement of the counterbores in the preferred embodiment can lead in a straightforward manner to a device which can also sort and count Susan B. Anthony dollars and U.S. half dollars.

There are two fundamental novel aspects of the coin discrimination apparatus of the present invention which allow it to be practically applied to the high throughput environment of a rotating drum coin handler. First, a novel coil structure for use in a coin sorting apparatus was invented which takes the form of a balanced transformer wound around a common core. The primary of the transformer serves as the excitation coil and the secondary of the transformer serves as the detector coil. In the preferred embodiment, four separate coils, arranged in spaced apart pairs wrapped about a common core having a common longitudinal axis, are disposed such that the lower pair of coils comprises part of the primary and part of the secondary of the balanced transformer, and similarly, the upper two coils are part of the primary and part of the secondary. In the preferred embodiment, the coil nearest the path of a passing coin is a portion of the transformer's secondary and the immediately adjacent coil lying above same is part of the primary. After a significant space along the longitudinal axis of the coil is traversed, one meets the third coil which constitutes the remainder of the transformer primary. The top coil constitutes the remainder of the secondary. Ideally, physical embodiments of the novel coil of the present invention would constitute an ideal air core transformer. In the preferred embodiment, a small ferrite bead, movable along the longitudinal axis of the transformer, is employed for balancing same.

The second fundamental aspect of the novel coin discriminator is its use of an excitation signal having multiple frequency components spaced significantly apart in the spectrum. It is known to those skilled in the art that there are significant non-linearities in metal core inductors. In the present apparatus, air core coils wound as a transformer are used in which non-linearities are exhibited in the coil coupling through eddy currents induced by passing coins. Essentially, the coil and its associated signal processing circuitry operates as an eddy current detector. At frequencies below 4 kiloHertz, the alloy content of the coupling coin dominates the coupling characteristics. At frequencies above 30 kiloHertz the size of the coin dominates the coupling, and thus the signal output, characteristics. It should be noted that this statement is true given the constraint that the excitation signal induces an essentially uniform field across the entire area which the coin may occupy as it passes the sensing coil. In the present invention, the transformer coils, described hereinabove, are sized so that a substantially uniform field is created across the entire width of a counterbore passing the coil as the drum rotates.

It is known to those skilled in the art that as frequency of the excitation signal is lowered, under the above stated assumption of the uniform field in the counterbore, the change in inductance for high frequency signals is relatively insensitive to the metallic content of a passing coin. The skin effects tend to appear and the change in coupling will be primarily due to the size of the passing coin.

The inventors of the present invention have applied this knowledge in a novel fashion to produce a multi-frequency excitation signal which is mixed at the input to the transformer primary and separated at the output of the detector coil in order to detect contributions of the output signal from both the high frequency and low frequency excitations. In the preferred embodiment, the high frequency excitation is on the order of 100 kiloHertz and the low frequency excitation is on the order of 1.5 kiloHertz.

It is within the scope of the present invention, and may be required with certain mixes of non-U.S. coinage, to use frequencies other than the two used in the preferred embodiment. Additionally, it may be desirable under circumstances which will be apparent to those skilled in the art in light of the present disclosure, to use more than two frequencies. Additionally, it is within the scope of the present invention to measure both amplitude peak and width of the output signals from the detectors at the various frequencies in order to discriminate among coins of similar sizes and alloy contents, particularly in situations such as the European market in which a plurality of coinages of different nations are often found mixed in batches of coins which need processing.

The inventors of the present invention have discovered that three basic signature parameters are derived from these signals which can be dependably used to discriminate among a wide variety of coin denominations.

Like most coin discriminators employing excitation and detection coils, the magnitude characteristic of the output signal of the detection coil will have some form of characteristic shape as the coin passes, reaching a maximum magnitude when the coin is most nearly centered beneath the inductor. The magnitude characteristic rises as the coin approaches the center and falls as it leaves the center. The inventors of the present invention have discovered that the width of the pulse contributed by the high frequency signal component and its peak value can be uniquely correlated to the size of various coins commonly used in modern coinage systems throughout the world. The width of a magnitude characteristic, as described herein, refers to the temporal width of the pulse between points at which it crosses a predetermined threshold in each direction. In other words, the width of the pulse is equal to the period of time between the event of the magnitude characteristic crossing a predetermined threshold in the positive direction and the event of the magnitude charcteristic subsequently falling below the threshold.

While the preferred embodiment of the present invention detects both width and peak value of the magnitude characteristic of the detected high frequency signal, for United States coinage it has been found only necessary to use the peak value from the low frequency signal as a signature component. Thus, the present invention uses a single balanced transformer detection coil which is excited with two relatively widely spaced frequency components to detect both size and metallic content of coins. The detection is accomplished by separating the high and low frequency signal components at the secondary of the transformer and detecting three signature characteristics. The three signature characteristics are the pulse width of the magnitude characteristic for the high frequency component and the peak value of same, and the peak value of the low frequency component. From these three signature characteristics, it has been determined that all coins in a typical coinage system, such as United States pennies, nickels, dimes, and quarters, half-dollars and dollars can be reliably identified.

As was the case in the apparatus of the Hull patents, id., jets of compressed air are used to blow a detected coin out of the counterbore and into a coin receiving conduit for collection or packaging.

In the preferred embodiment of the present invention, the Hull apparatus has been modified so that six distinct coin conduits are disposed within the interior of the rotating drum substantially parallel to the axis of rotation of the drum and perpendicular to the direction of travel of the counterbores. Since each conduit is dedicated to receipt of coins of a particular denomination, appropriate timing circuitry is provided to activate a compressed air jet over the appropriate coin conduit when a counterbore containing a coin of the appropriate denomination becomes registered thereover.

In the preferred embodiment, there are ten annular rings containing 40 counterbores each which comprise the rotating drum within the above mentioned vacuum plenum. Therefore, the preferred embodiment has a rank of ten like coils set above the rotating drum. Down stream, in the sense of the direction of the drum's rotation, six ranks of solenoid operated air valves are disposed over the six respective coin conduits. Therefore, there is one solenoid operated air valve over each coin conduit for each rotating annulus of the drum. A seventh rank of air valves is provided to return coins to the interior of the drum under circumstances described hereinbelow.

Additionally, the present invention employs a set of lag sensors which are downstream from the air valves. The lag sensors need only detect whether or not a metallic coin is present in a manner similar to the detectors used in the Hull coin packaging apparatus. Since the ability to reliably count coins is an important function of this apparatus, the lag sensor is used to confirm ejection of a coin by the solenoid operated air valves when same is operated. Therefore, for a given denomination of coin detected at a particular counterbore location, the appropriate air valve will be operated as the counterbore location passes over the appropriate coin conduit. Subsequently, this counterbore position will approach the lag sensor and the machine tests to see if a coin is still present. If the coin is not present, this is taken as confirmation that the air jet from the solenoid operated valve was successful in ejecting the coin from the counterbore into the conduit and the tally for that denomination is incremented. If the coin is still present, no incrementing of the coin count takes place.

It is, of course, possible to include an additional lag sensor intermediate each of the air valves in the preferred embodiment to detect the presence of an air valve which was stuck in an open position. However, the expense of the additional sensors and the accompanying requirement of physical spreading of the sensor/air valve array on the apparatus does not, in the opinion of the inventors, justify the additional expense. It is desirable to periodically test the condition of the valves by operating the apparatus in a mode in which all of the air valves are activated, and subsequently introducing coins into the apparatus, detecting the presence of same in a particular counterbore location, and testing for the presence of a coin at the lag sensor with none of the valves being operated. If the absence of a coin is detected in a particular channel, it is an indication that one of the air valves over that channel is stuck in an on position and is causing continuous and unintended ejection of coins.

It is further known to those skilled in the art that the proximity of the coin to an excitation and detection coil structure will significantly affect the magnitude of the output signal from the detector coil in inductive type coin discriminators. In the present invention, the rank of detector coils is located at a particular position very close to, but lying above, the outer surface of the rotating drum. Since the drum is relatively large, very slight irregularities in the axis of rotation can cause significant differences in the space between the detector coil and different counterbore positions along the same annular ring. In other words, if the drum is rotating slightly off axis, it will tend to wobble somewhat and certain of the counterbore positions will pass very close to the coil while counterbore positions on the opposite side of the annulus will be spaced farther from the coil. Naturally, this could have a tendency to cause inaccurate or unreliable analysis of the signatures obtained as the same coin passes the same coil. In other words, very slight mechanical imperfections in the drum rotation can lead to significant deferences in the signatures under conditions which are otherwise identical.

In order to counteract this possibility, the preferred embodiment of the present invention calibrates each counterbore position prior to operating the machine as a sorter. In the calibration process, a batch of coins of known denomination is inserted into the rotating drum. It is known to those skilled in the art that even coins of a particular denomination within a particular coinage system will have different signature characteristics due to varying states of wear and changes in metallic content at the time of minting which occur over the years. During calibration, the values for the signature signals described above are read as each counterbore position containing a coin passes the coil. The above referenced seventh rank of air valves blows each coin back into the interior of the drum where it will eventually become relodged in a counterbore position. Operating the apparatus by this method for a period of several minutes assures that each counterbore position is provided with a representative sampling of the coins of the particular denomination being calibrated. High and low values for the signature signals are stored in memory during calibration and used, for each counterbore position, when the machine is subsequently operated as a sorter.

As noted above, there is a seventh rank of solenoid operated air valves downstream from the last rank of valves over a coin conduit. Operation of one of these air valves blows the object in the counterbore back into the interior of the drum. These air valves are used both during the calibration process described hereinabove and to dislodge objects representing unknown sort values during operation of the machine. At this point in time, it is appropriate to introduce some of the terminology used in this specification. When the difference between detected signature values for an object in a counterbore position and the range of signature values for valid coins is sufficiently large, the apparatus makes a determination that the object is "off sort" and thus treats it as a bogus coin. Thus, references to an off sort value refer to a detected object which generates signature values which are so different from valid signature values that the object is ejected into a coin conduit dedicated to bogus coins and off sort objects.

A set of signature signals which are close, but not within the range, of any valid set of signatures is referred to as a "unknown". During operation of the machine, the valve associated with that particular annulus in the last rank of valves is operated when the particular counterbore containing the unknown object passes thereunder. In this way, the object is normally dislodged and blown back into the interior of the machine. There is a high probability that it will subsequently find its way to another counterbore. It should be noted that this operation increases the probability that a valid coin having metallic and size characteristics which are very marginal, will be properly sorted as a valid coin. If its signature characteristics are only slightly outside the range for a particular counterbore location, it is quite possible that they will fall in the range of signature characteristics for a different counterbore location in which the coin subsequently becomes lodged. Also, unknown values can be generated in the rare, but not impossible, event that a coin becomes lodged in the counterbore in a skewed fashion in which one edge of the coin is caught on a sidewall of the counterbore. Under the circumstances, the coin is not properly seated in the bottom of the counterbore well and will fail to produce appropriate signature signals, although they will normally fall within the unknown range rather than the off sort range.

It should be noted that in practical applications of the preferred embodiment, a very small number of unknowns are encountered. The unknowns are preferably defined in the present invention to provide a very accurate sort and count.

As will be appreciated by those skilled in the art from the description to follow, the coin discrimination method and apparatus described herein has utility in coin sorting and validation devices other than those of the type disclosed herein.

Therefore, it is an object of the present invention to provide a very high throughput and very reliable coin sorting and counting apparatus which can increase the coin throughput of state of the art prior art machines by an order of magnitude. It is a further object of the present invention to provide a reliable coin sorting and validation apparatus readily adaptable to a coin handling and packaging machine of the type disclosed in U.S. Pat. No. 3,751,871.

It is a further object of the present invention to provide a very high reliability coin sorting apparatus which can tolerate relatively large mechanical errors in the machinery which moves the coins past the detection locations.

It is still a further object of the present invention to provide a self-calibrating coin sorting apparatus which can be used to sort sets of coins from differing coinage systems with no modification other than re-execution of the calibration steps.

It is another object of the present invention to provide a coin discrimination apparatus which can reliably identify coins of different denominations within a standard coinage system using only coil detectors and which uses only peak magnitude and pulse width of the magnitude of the output signal from the detector coil as the relevant signature signals.

It is still a further object of the present invention to provide a sorting and counting apparatus which sorts and counts mixes of coins of a plurality of different national coinage systems which may include members in the sortable set which are of identical size but different alloy contents.

It is still a further object of the present invention to provide a coin sorting and counting apparatus which is useable in an environment in which tokens which may be of the same physical size as coins within the sorting set may be reliably sorted based on alloy content.

It is still a further object of the present invention to provide an improved coin sorting and counting apparatus using multiple reference frequencies and using both peak and width amplitude characteristics of detected output pulses as the coins pass the sensors, such pulses being produced in response to one or more of the aforementioned frequencies, to determine unique signatures for a plurality of similar coins.

That the present invention overcomes the drawbacks of the prior art and other machines, and fulfills the objects stated above, will become apparent from the detailed description of the preferred embodiment which follows.

BRIEF DESCRIPTION OF THE DRAWINGS

FIG. 11, consisting of FIGS. 11A through 11E show various states of the coin ejection memory queue for a typical example of a sequence of detected coins of particular denominations in two adjacent counterbores for one channel of the preferred embodiment.

DETAILED DESCRIPTION

Figure 1:
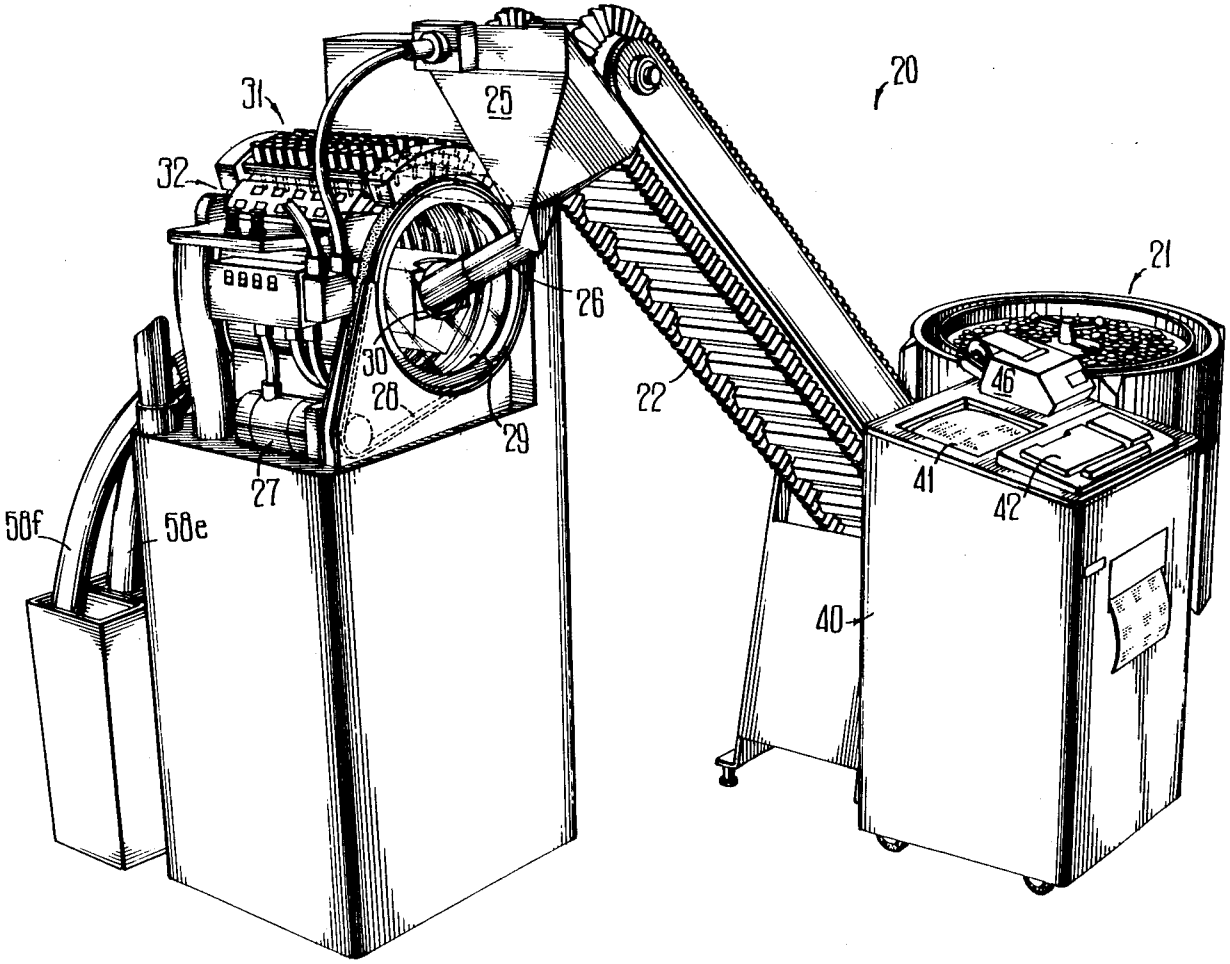
FIG. 1 is a pictorial view of the coin sorting apparatus of the present invention and associated machinery constituting its preferred environment.

Turning now to the drawing figures in which like numerals reference like parts, the preferred embodiment of the present invention will now be described.

FIG. 1 is a pictorial view of the apparatus of the preferred embodiment and the associated equipment used in its preferred environment. The coin sorter of the present invention is generally shown at 20 in FIG. 1. A conventional cleaning station is shown at 21 and is the location into which coins are initially deposited during processing by the apparatus. Cleaning station 21 is conventional in nature and is not, per se, part of the present invention.

Coins which leave the cleaning station 21 are lifted by a slat conveyor 22 up to an input chute 25. Coins from the input chute 25 are carried by input chute 26 to the interior of a rotating drum, described in further detail hereinbelow. The above mentioned drum is rotated by a motor 27, the output of which is coupled by a belt 28, shown in phantom in FIG. 1, to the exterior of the drum. One end of the drum containing chamber is sealed by a clear Lexan polycarbonate plastic window 29, with an opening at 30, where input chute 26 passes through window 29.

An operating console 40 is also shown in FIG. 1. The console includes a CRT 41 which is used in monitoring performance of the machine and a keyboard 42 used for controlling the apparatus. One print station puts out conventional eight and one half inch wide paper shown at 45 which is used for report printing, and providing technical data during service and maintenance. Additionally, a smaller printing device 46 is used for making hard copy of tabulations of particular sort runs which may be provided with the collected sorted output of coins from the machine.

An array of 70 solenoid operated air valves is disposed about the upper portion of the periphery of the chamber in which the drum rotates. The array is generally indicated at 31 in FIG. 1. The lag sensing coils are also visible in FIG. 1 and are indicated generally at 32 in the drawing figure.

In the preferred embodiment, each of the solenoid operated air valves shown at 31 has a twisted pair of conductors attached thereto for operating the solenoid. These are omitted from the drawing of FIG. 1 for the sake of simplicity. Likewise, output leads from the proximity sensors shown at 32 are also omitted from the drawing figure.

As noted hereinabove, the coin sorter apparatus is physically constructed in a manner quite similar to that of the apparatus shown in the above referenced patents to Hull et al., which have been incorporated by reference in this specification. Therefore, details of the vacuum plenum and the rotating drum containing a plurality of counterbores can be understood by reference to the above referenced Hull patent. For the sake of completeness of this specification, a few details of same will be pointed out.

Figure 2:
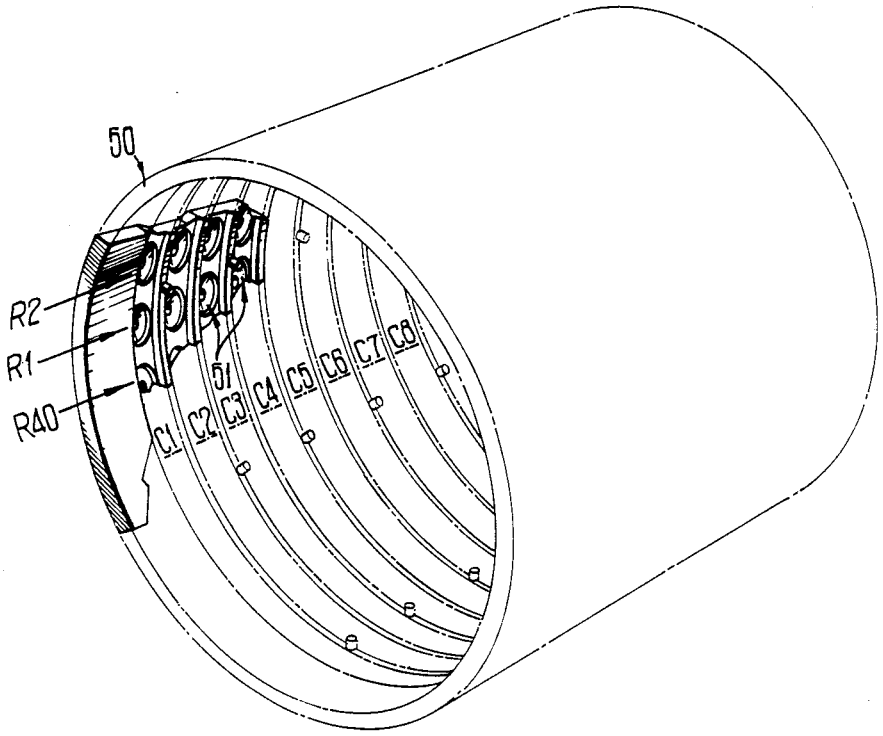
FIG. 2 is a pictorial view of the interior of the rotating drum of the preferred embodiment showing the coin accepting counterbores.

Turning next to FIG. 2, a pictorial view of the drum 50 is shown. The drum is constructed of ten side-by-side annular channels C1 through C10, eight of which are visible in the drawing of FIG. 2. Each channel has a predetermined number, forty in the preferred embodiment, of equally spaced counterbores 51 about the periphery of the annular segment. Each of the counterbores is identical, and all counterbores are referred to by the common reference numeral 51 herein. Each of the counterbores 51 has a centrally located hole 52 which passes all the way through the channel to the outside of the drum.

In the same manner as the apparatus of the above referenced Hull et al. patents, the drum is rotated within a plenum in which a partial vacuum is maintained during operation. Therefore, the pressure on the outside of the drum is lower than that on the inside and air tends to rush from the interior to the exterior of the drum through holes 52. During operation of the apparatus, the partial vacuum created by the plenum (not shown) causes coins to become seated on the floors of the counterbores 51.

As indicated in FIG. 2, each of the channels has forty counterbores spaced around its periphery. The center lines of the counterbores for each channel are aligned along a line parallel to the axis of rotation of the drum such that adjacent counterbores on adjacent annular channels form rows of counterbores. The rows are numbered R1 through R40. Thus, the counterbores disposed on drum 50 may be thought of as a rectangular matrix of counterbores having ten columns and forty rows, all of which are wrapped around the surface of a cylinder with row one being adjacent to row forty at the location where the rectangular array is joined, end to end.

The definition of any given row as row one is arbitrary, and is defined in the preferred embodiment by a master timing mark (not shown) which defines the first row. The master timing mark is detected by photosensitive devices in a manner which is conventional, and well known to those skilled in the art. Additionally, timing marks (not shown) are located at every row such that they occlude the photodetector of an optocoupler when a given row of counterbores is aligned with a coin sensor, as explained hereinbelow. Again, the use of such devices for synchronizing external digital control circuitry to mechanically rotating equipment is conventional and well known to those skilled in the art.

Figure 3:
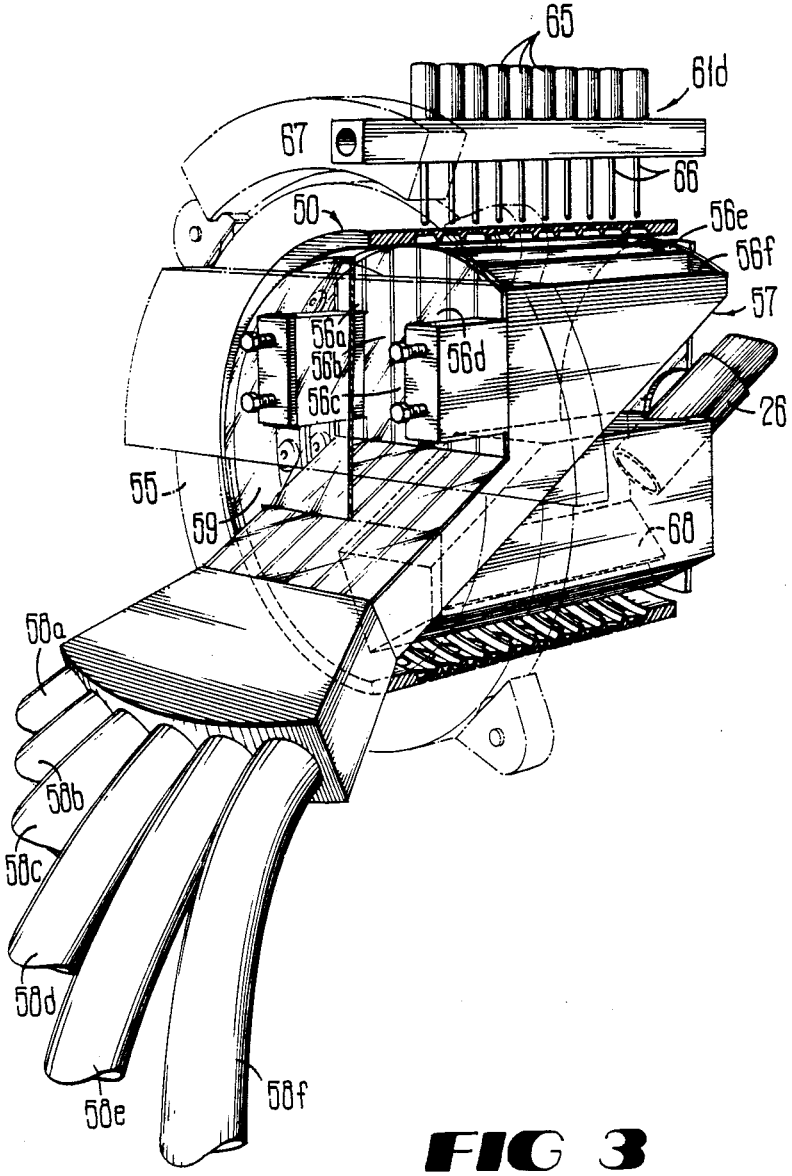
FIG. 3 is a pictorial view of the coin discharge paths of the preferred embodiment with certain elements shown in phantom.

FIG. 3 shows certain details, some of which are depicted in phantom, of the interior of the mechanism. It also shows certain aspects of the preferred embodiment which differ from the details of the apparatus disclosed in the Hull patents. The vacuum plenum in which drum 50 rotates is supported at one end by end cap 55. It should be noted that the proximate end of the drum apparatus shown in FIG. 3 is the opposite end of same from that depicted in FIG. 1. As may be seen in FIG. 3, counterbores 50 rotate over a plurality of coin receiving stations 56*a* through 56*f*. The top openings of stations 56*e* and 56*f* are visible in FIG. 3 where a portion of drum 50 is broken away. The coin receiving stations 56 each feed a coin receiving conduit having a slanting bottom generally shown at 57 in FIG. 3. Each of the coin receiving stations 56 is in turn coupled to one of six coin output conduits 58*a* through 58*f* shown in FIG. 3. The assembly of the coin conduit apparatus passes through a second Lexan window 59 shown in FIG. 3.

A typical row of solenoid operated air valves is shown at 61*d* in FIG. 3. The seven rows of air valves are designated 61*a* through 61*g* in this specification and it will therefore be appreciated that row 61*d* is over the fourth coin receiving station 56*d*. As noted hereinabove, the seventh row of air valves 61*g* (not shown in FIG. 3) is located along the periphery of the housing over drum 50 such that coins blown out of counterbores at that location are returned to the interior of drum 50.

A typical valve is shown at the distal end of row 61*d* and includes a solenoid 65 and an air jet 66. Each of these devices controls a valve (not shown) which couples pressurized manifold 67 to its associated air jet 66. A source of compressed air (not shown) is connected to manifold 67 such that activation of solenoid 65 will cause compressed air to rush through air jet 66. This occurs when a respective one of holes 51 is directly under the bottom end of air jet 66, and any coin lodged in the counterbore 51 associated with the hole 52 will be blown into coin receiving station 56*d*.

A deflector plate 68 distributes coins entering the interior of the drum from input chute 26 along the length of drum 50. A level switch (not shown) controls the slat conveyor which controls the rate at which coins are introduced into the drum for agitation and deposit in the counterbores.

It should be understood that air jet 66 from the solenoid operated air valves pass through the exterior (not shown) of the vacuum plenum. The points at which the jets 66 pass through the plenum wall are made appropriate airtight. Thus, the solenoids 65 sit on the exterior of the drum apparatus as shown in FIG. 1 and the air jets 66 terminate in the interior of the vacuum plenum just over the rotating outer surface of drum 50.

Figure 4A:
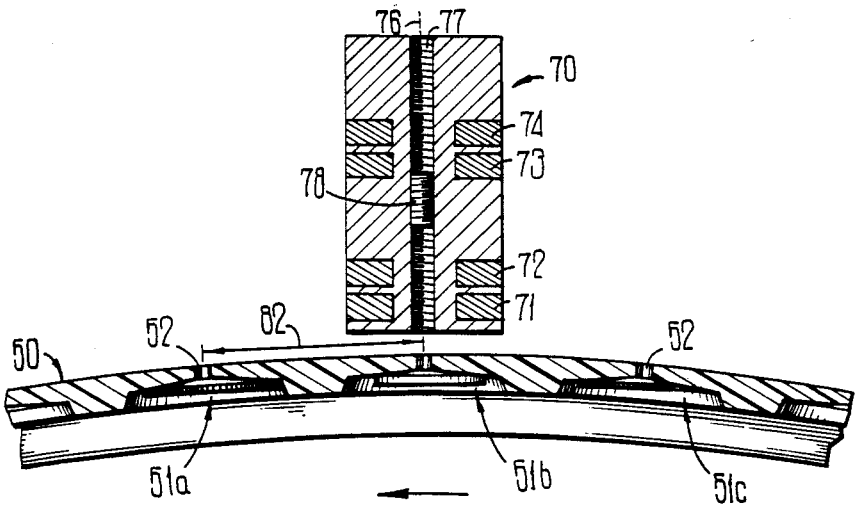
FIG. 4A is an elevated section view showing a typical set of counterbores rotating past the novel detector coil of the preferred embodiment and showing the coil in cross section.

FIG. 4A is a cross-sectional view showing the preferred embodiment of the sensing coil 70 and an arcuate segment of rotating drum 50. The section is taken through the center line of the coil and the center line of a typical one of the annular channels of the drum 50. Three exemplary counterbores 51*a* through 51*c* are shown in cross-section, each of which has the characteristic centered hold 52 bored through the center of the counterbore to the outer surface of the drum.

Physically, coil 70 includes four coils 71 through 74 wound around a bobbin 75 constructed of material of very low magnetic permeability. In the preferred embodiment bobbin 75 is made of Delrin plastic. The coils are arranged in pairs such that coils 71 and 72 are wound around the lower portion of bobbin 75 and coils 73 and 74 are vertically displaced therefrom. The coils 71 through 74 are wound perpendicular to longitudinal axis 76 of the bobbin. In the preferred embodiment, each of the coils 71 through 74 is constructed of approximately 200 turns of 32 gauge copper magnet wire.

Longitudinal axis 76 also defines a center line for a threaded hole, shown at 77, which passes through the length of the bobbin. Journaled within hole 77 is a threaded ferrite bead carrier. The mating threads on hole 77 and bead 78 allow the carrier to be positioned longitudinally between coils 72 and 73. As may be seen from inspection of FIG. 4A, the ferrite bead is a fairly small mass of magnetically permeable material and its purpose is only to make minor adjustments in the balance between the two secondary coils. If coils 71 through 74 were perfectly wound, the sensing coil would approximate an ideal air core balanced transformer and there would be no need for the bead.

Figure 4B:
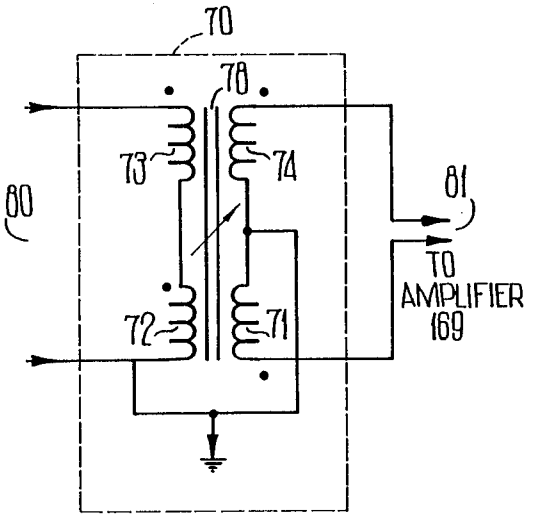
FIG. 4B is a circuit diagram of the preferred embodiment of the detector coil of the present invention.

FIG. 4B shows the electrical equivalent circuit of sensor coil 70 shown in FIG. 4A. The input primary port is shown at 80 in FIG. 4B and the output or secondary port of the balanced transformer is indicated at 81. As may be seen by the concurrent inspection of FIGS. 4A and 4B, the inner two coils 72 and 73 of the physical bobbin form the primary of the balanced transformer and the outer two coils 71 and 74 form the secondary. In FIG. 4B, the transformer is indicating as having a variable metallic core at 78 which is embodied by ferrite tuning bead 78 shown in FIG. 4A.

In cross sections perpendicular to longitudinal axis 76, bobbin 75, and thus coils 71 through 74, are rectangular. In FIG. 4A, the cross section is taken parallel to the shorter side of the rectangle. Since the width of the bobbin, and thus the coils, is approximately equal to the diameter of counterbores 51, it will quickly be appreciated that the length of the rectangular coils is significantly greater than the diameter of the counterbores. The combination of the electrical arrangement shown in FIG. 4B in the above described geometry of the coils and bobbin has been found to give extremely good results in a non-contact coil sensor which can discriminate both coin size and alloy. First, it is important that the induced field be substantially uniform across the entire area of the floor of a counterbore 51 when it is centered under a coil 70. Thus, coils of other geometries can be used to construct embodiments of the present invention but a coil having a rectangular bobbin with an aspect ratio of approximately 2.75 of the inner dimensions of the bobbin has been found to give what the inventors believe are the best results and practical embodiments of the present invention.

In the preferred embodiment, bobbin 75 is one inch wide (the horizontal dimension shown in FIG. 4A) by 1.6 inches deep by 2 inches high, the vertical dimension shown in FIG. 4A. The exterior of coils 71 through 74 are indented slightly from the outer wall of the bobbin and are sealed in plastic.

The effects of this geometry in the above described constraint on the field across the counterbore will now be briefly described so that the inventor's solution to the problem of indeterminate coin positioning within the counterbores may be understood. Three exemplary counterbores 51*a* through 51*c* are referenced in FIG. 4A. As noted above, the counterbores of the preferred embodiment have a diameter which is only slightly larger than the diameter of a U.S. quarter. Naturally, the only requirement for the present invention is that the diameter of the counterbores be large enough to accommodate the physically largest coin of interest in a set of coinage or tokens with which the device will be used. In the example shown in FIG. 4A, counterbore 51*a* has a U.S. quarter seated therein, counterbore 51*b* has a U.S. nickel seated therein, and bore 51*c* has a dime.

The case of the quarter is relatively trivial because it will be centered in the counterbore as a result of the above described size of same. However, the cases for physically smaller coins require the inventors of the present invention to make sure that the problem of indeterminate positioning of such coins within the counterbore could be dealt with successfully. First, the problem will be apparent to those skilled in the art that a coin having a radius $r_2$ smaller than the radius $r_1$ of the counterbore may have its center located anywhere along a locus of points constituting a circle of radius $r_1-r_2$ centered at the center of the counterbore. Additionally, the center of the coin may be located anywhere on the circle of radius $r_1-r_2$ or anywhere within the circle.

The indeterminate position of the smaller coins leads to the result that the coins may have their centers positioned ahead of or behind the center of the counterbore aligned with a longitudinal axis of hole 52. Thus, the coin will be displaced laterally from a tangent to the surface of drum 50, passing through hole 52 and pointing in the direction of rotation of the drum. In other words, the displacement of the center of the coin from the center of the counterbore may have a significant component parallel to the axis of rotation of the drum.

Also, smaller coins may be displaced ahead or behind the center of the counterbore with respect to the direction of rotation.

The former displacement leads to the practical requirement that the long side of the rectangular geometry of coils 71 through 74 be sufficiently long so that the lateral position of a small coin within the counterbore will not vary the electromagnetic effect of the coin passing under the coil. Those skilled in the art will appreciate the need to increase the length of the long side of this rectangular geometry so as to prevent boundary conditions from varying the electrical response, which would have a significant impact on the electrical response to, for example, a U.S. dime centered in the counterbore and a U.S. dime displaced laterally by a distance $r_1-r_2$. Therefore, the problem of inconsistent response to smaller coins which results from lateral (with respect to the direction of rotation) displacement of the coin from the center of the counterbore is overcome by the increased width of the rectangular shape of coils 71 through 74.

A U.S. dime which is displaced along the direction of rotation of the drum is shown seated in counterbore 51*c* at FIG. 4A. If it is assumed for the moment that the dime is laterally centered within the counterbore, it will be apparent that the aberration in the machine response will be solely a function of the timing of the electromagnetic impact of the coin's passing. Since the center of the coin in this case is traveling ahead of the center of the counterbore by a distance $r_1-r_2$, it is important that the signal processing circuitry be insensitive to this jitter between the temporal locations of the peaks of the pulses produced by the passing coins. In the preferred embodiment, two parameters of the machine assure that this result is accomplished. First, the spacing between adjacent counterbores within any one of the annular channels, indicated by dimension line 82 in FIG. 4A, is sufficiently greater than the maximum displacement between the center of the coin and the center of the counterbore (i.e., $r_1-r_2$) such that the machine may readily discriminate between the passing of adjacent coins. In other words, there is no intercoin interference. Secondly, as noted hereinabove, the present invention has achieved a coin detection and validation arrangement in which the peak value of signal variations and the width thereof are the only signature signals necessary to completely discriminate among coins in a typical set of coinage. Therefore, a significant amount of asynchronism between the rotating machinery and the occurrences of both the signal peak and the positive and negative crossings of the reference voltage may be easily tolerated.

To this end, it should be understood that the above described timing devices disposed on drum 50 (not shown) are arranged such that a "dark time" is provided when one of counterbores 51 is physically centered under air jets 66 of one of the output air valves. The time between successive dark times for the timing apparatus is the time required for a first counterbore to be centered under a given coil and the time for the next adjacent counter bore to become centered.

The timing apparatus of the preferred embodiment synchronizes with the dark time pulses and uses these pulses which occur when the timing marks occlude optocouplers, to ascertain the relative positions of counterbores 50 with respect to both the rows 61 of air valves and sensing coils 70. Since the marks are arranged such that the occlusion, and thus the dark time, occurs when the holes 52 are centered under air pipes 66 (FIG. 3) the apparatus will activate appropriate ones of solenoid 65 at the center of the dark times. When acquiring the data for the signature signals, the apparatus reads data at a time which is substantially midway between the termination of the most recent dark time and the onset of the next one. Naturally, the onset of the next one is determined by locking on to the pattern of timing for the light and dark time as cylinder 50 rotates. In other words, the readings are taken at a point in time when mid-points between adjacent counterbores are centered under the sensing coils 70. This assures a condition in which the response of the coil to the coin most recently passed is stored, and can be read prior to the time the signals in the coil begin responding to the approach of the next adjacent coin.

Naturally, equivalent arrangements may be constructed by reversing the significance of the light and dark times and using electronic signals derived from devices other than optocouplers in manners which will be familiar to those skilled in the art.

Figure 5:
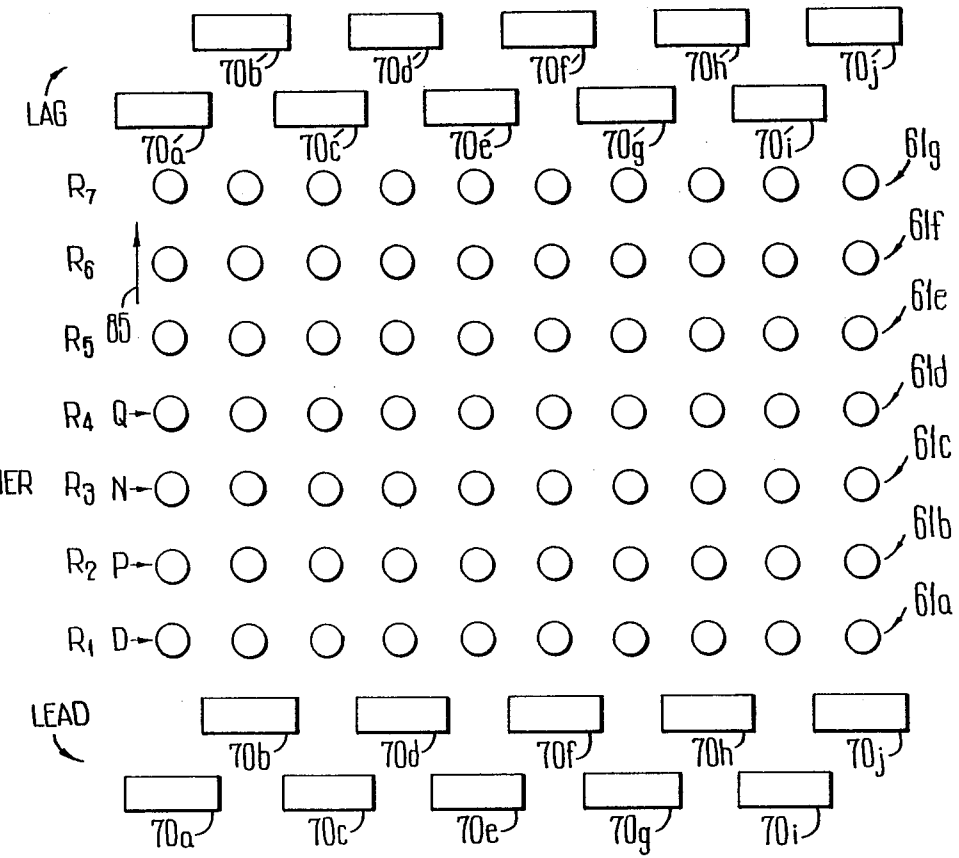
FIG. 5 is a diagrammatic projection of the array of sensor coils and air valves used in the preferred embodiment of the present invention.

Turning next to FIG. 5, a planer diagram of the layout of sensing coils 70 and rows 61 of the solenoid operated valves is shown. On the left hand side of the drawing, row designations for the valves are shown as $R_1$ through $R_7$. These correspond, respectively, to rows 61*a* through 61*g*. On the left hand side, the direction of rotation of the drum, relative to the array depicted in the drawing figure, is shown by arrow 85.

Since, as described above, the length of the rectangular geometries of coil 70 is significantly wider than the diameter of the counterbores, in the preferred embodiment a row of ten sensing coils cannot be physically formed due to spatial limitations. Therefore, the ten lead sensing coils 70*a* through 70*j* form a logically single row of sensors, but are physically staggered such that each coil is displaced from the two adjacent coils in the direction of rotation by a distance equal to the intercounterbore distance shown as 82 if FIG. 4A. Therefore, coils 70*a*, 70*c*. . . through 70*i* are physically located on one row. Similarly, coils 70*b*, 70*d*. . . through 70*j* are physically located downstream from the previous row and are displaced by one interbore distance. Timing circuitry in the detection circuitry of the preferred embodiment appropriately delays activation of the valves based on the signals from the leading row, containing coil 70*a*, by a period of time equal to one fortieth of the time required for complete revolution of the drum so that the output signals from, for example, coils 70*a* and 70*b*, become logically and electrically synchronized within the machine. In the preferred embodiment, drum 50 rotates at approximately 16 revolutions per minute. Therefore, the time required for adjacent center holes 52 to become aligned under a given point exterior to the drum is approximately 93 milliseconds. Those skilled in the art will recognize that this is a relatively long time in the world of modern microprocessors and that complete data acquisition for a row of sensors, together with an appropriate analysis to identify the coins, can be made within the 93 millisecond interbore time period.

A correspondingly staggered set of lag coils 70*a*′ through 70*j*′ is shown at the opposite end of the array, at the top of FIG. 5. The same physical constraints described hereinbelow require the staggering of the lag coils. However, as will be apparent from the description hereinbelow, the lag coils need only be able to reliably detect the presence or absence of any coin within an embodiment of the present invention and thus simpler coil geometries which would allow ten coils to be set side by side in single row may be used in constructing the lag sensors of embodiments of the present invention.

In the preferred embodiment, air valve row 61*a* is disposed over the coin receiving station for dimes. Similarly, row 61*b* of the air valve is over the penny receiving station, 61*c* over the station for nickels, and 61*d* over the station for quarters. The selection of the stations is arbitrary and any convenient selection of the relative arrangement of the denominational significance of the receiving station may be employed. Rows 61*e* and 61*f*, corresponding to rows $R_5$ and $R_6$ are not normally used for U.S. coins. However, of course, either of them may be used for tokens in transit systems and the like which may be present in coin input to be sorted.

It should be noted that the software controlling the preferred embodiment assigns each of the chutes their denominational significance and use. Therefore, any chute may be assigned to receive any denomination under software control without changing the mechanical configuration of the machine. To this end, known statistics about the contents of the input (or other criteria) may be used to assign denominational significance to the chutes in a manner which will lead to the most efficient sorting procedure for the operation at hand. This may be done statically or dynamically.

For example, if a load of coins is obtained from pay telephones, it is likely that it will contain a large number of quarters. The dynamic assignment of denominational significance allows the user to assign one particular coin chute to quarters until a certain sum of money in quarters is ejected through the chute. As soon as this event occurs, a second chute is assigned to quarters and a message is provided at the console alerting the attendant that the predetermined amount of money in quarters is present at the output of the first chute. The attendant may then take appropriate action, such as separate bagging of the output from the first chute, while coin sorting continues with quarters being ejected to the second chute.

This arrangement allows the present invention to be operated in a continuous sorting and counting process rather than one which is limited to batch processes.

In the preferred embodiment, row $R_6$, corresponding to row 61*f* of the air valves, is disposed over coin receiving station 56*f* which is used to received off sort objects. As noted hereinabove, off sort objects are those which are clearly detectable, but whose signature signals are so far out of range of any of the valid sets of signature signals that they are treated as a bogus coin. Slugs, and other stray metallic objects which may find their way to the coin sorter will be rejected at this location. Off sorts are treated by the software as any other denomination. Therefore, any chute may be assigned to receive off sort objects.

The last row 61*g* of the air valves is disposed downstream, in the rotational sense, from the last coin receiving station 56*f*. Therefore, any object blown out of a counterbore at row $R_7$ will be returned to the interior of the rotating drum. As noted hereinabove, the present invention activates such valves when unknown objects are detected in the counterbores. An unknown object is one which generates signature signals close to those defined as valid for a member of the valid coinage set, but are not within range. It should be noted that this statement must be understood in the context of the range of valid signature signals in the present invention, i.e., that a range is defined for each of the 400 counterbore locations used in the preferred embodiment. While these are naturally very close to each other in value, they are not all identical for a given coin denomination. Coins which are marginal with respect to content or size, due to age, vandalism, chemical abuse, or the like, may be detected as unknown objects by the apparatus when passing sensing coil 70 in one counterbore, but may fall within a valid range when traveling past a different sensor in a different counterbore.

Naturally, as unknown objects accumulate within the machine, they will eventually be the only objects left within the interior of the drum. The present invention is constructed such that, if and when this condition is encountered, the apparatus may be placed in a mode of operation which all objects are ejected through a particular one of the coin receiving stations and out a particular chute, to finally clear the contents of the machine.

In the preferred embodiment, the lead sensors are the primary detectors and are used as the primary coin validation and discrimination devices. The lag sensors are used only to detect the presence of an object in a counterbore after it has passed under the array of solenoid operated valves. The preferred embodiment of the present invention not only validates and sorts coins, but it counts the number of coins output to each coin receiving station 56 and thus the number of coins passed to each coin output conduit 58 (FIG. 3). Therefore, it is considered important to confirm the ejection of a coin when the apparatus detects its presence and denomination, and provides an appropriately timed signal to the appropriate air valve in one of rows 61*a* through 61*d*. If everything is operating properly, the coin will be ejected into the coin receiving station and the lag sensor on the channel for this coin will detect no coin at the time this particular counterbore location passes under one of the lag sensors 70′.

If the lag sensor detects no coin, it is assumed (with great justification) that the coin was properly ejected into the proper coin receiving station. Therefore, the count for this particular denomination of coin is incremented under these conditions. If the lag sensor detects a metallic object still present in this particular counterbore, the count is not incremented. Those skilled in the art will quickly appreciate that it is a matter of design choice whether to increment the counter when the coin is detected and then decrement same if the lag sensor detects that the coin is still present or simply not to do the incrementing until proper coin ejection is confirmed by the absence of a detected signal at the lag sensor.

Additionally, the following should be understood about the excitation sources employed in the preferred embodiment. As will be described in greater detail hereinbelow, the high frequency component of the excitation signal is applied alternately to the staggered rows of lead coils 70*a* through 70*j* in the preferred embodiment. Therefore, the high frequency component will be applied to excite coils 70*a*, 70*c*. . . through 70*i* at times when the signal is not being applied to coils 70*b*, 70*d*. . . 70*j*. Alternately, the latter set of coils will be excited by the high frequency signal while the former set is not.

In the preferred embodiment, this switching has a fifty percent duty cycle and is switched at a rate equal to the frequency of the low frequency excitation signal.

The inventors of the present invention discovered that this arrangement reduces cross talk between the coils which might otherwise result from the excitation by the high frequency signals. Therefore, the distance between two adjacent coils being excited by the high frequency signal at any point in time is two channels, for example, the space between coils 70*b* and 70*d* shown in FIG. 5.

Figure 6:
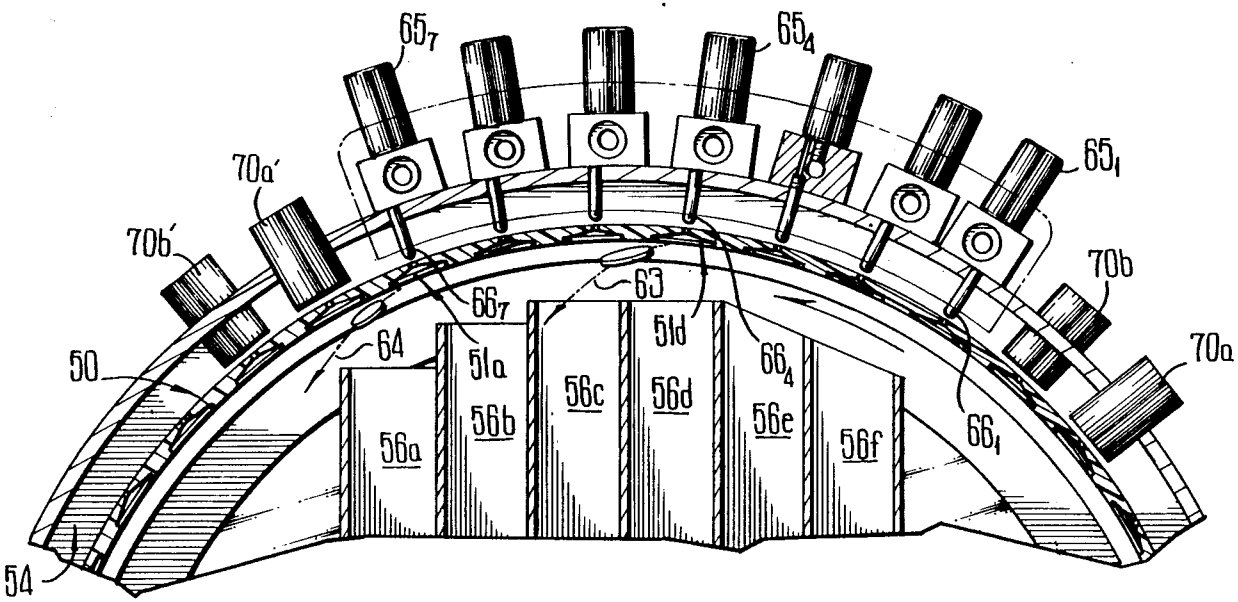
FIG. 6 is an elevational section view showing the rotating cylindrical drum under the array of air valves in the coin receiving stations in the interior of the drum.

FIG. 6 is a section elevational view of one end of the apparatus which shows cylindrical drum 50 rotating over coin receiving stations 56 and also illustrates the positions of detector coil 70 and solenoid operated air valve 65. It is believed that FIG. 6 will assist in understanding the overall operation of the apparatus. Drum 50 rotates in the direction of arrow 53 shown in FIG. 6. The cross section of the rotating drum is taken through the counterbores associated with channel 1. Therefore, these counterbores pass under lead detecting coil 70*a*. Coil 70*b* of one of the even numbered channels (channel 2) is also visible in FIG. 6 and illustrates the offset, in the sense of the direction of rotation of the drum, among the lead sensing coils for the odd and even numbered channels of the preferred embodiment. Downstream from these coils, lag coil 70*a*′ is used to detect continued presence of a coin in one of the counterbores of channel 1. Lag coil 70*b*′ associated with channel 2 is also visible in the drawing.

The partially evacuated plenum is shown at 54. It creates a negative pressure tending to pull coins into counterbores 51 until they are ejected in response to the operation of one of solenoid operated air valves 65. For purposes of FIG. 6, the plurality of solenoid operated valves 65 associated with channel 1, have been further denoted by subscripts 1 through 7 indicating their position along the direction of rotation.

Two exemplary coins are shown after they have been ejected from counterbores 51*a* and 51*d*. It should be understood that the drawing illustrates counterbore 51*a* in its position when valve $\mathbf{65}_7$ is activated sending a jet of air through pipe $\mathbf{66}_7$ ejecting the coin. The approximate trajectory of a coin ejected from counterbore 51*a* is illustrated by dashed arrow 64. The coin illustrated along this line is for purposes of indicating the approximate trajectory of a coin so ejected and not to indicate the coin's position at the time it is ejected from counterbore 51*a*.

As shown in FIG. 6, coins ejected in response to operation of value $\mathbf{65}_7$ are unknown objects which are returned to the interior of rotating drum 50. A second exemplary trajectory is illustrated by dashed arrow 65 showing that a coin ejected from counterbore 51*d* in response to operation of air valve $\mathbf{65}_4$ will be deposited in coin receiving station 56*c*. The inventors used a combination of calculations and empirical tests to align the positions of air valve 65 with respect to particular ones of coin receiving stations 56 into which such valves would eject coins to take account of the tangential component of the velocity imparted by the drum rotation and the radial component of velocity imparted by the air exiting one of nozzles 66.

Between the time a coin in a particular counterbore location passes under lead coil 70*a*, and the time it reaches the first of air valve $\mathbf{65}_1$, the signature detection apparatus of the present invention acquires the three signature signals used in the preferred embodiment, compares same to stored calibration values, and makes an appropriate decision as to which one of air valves 65 should be operated to remove the coin from the counterbore. The apparatus which acquires the signature signals and makes this decision will now be described.

Figure 7:
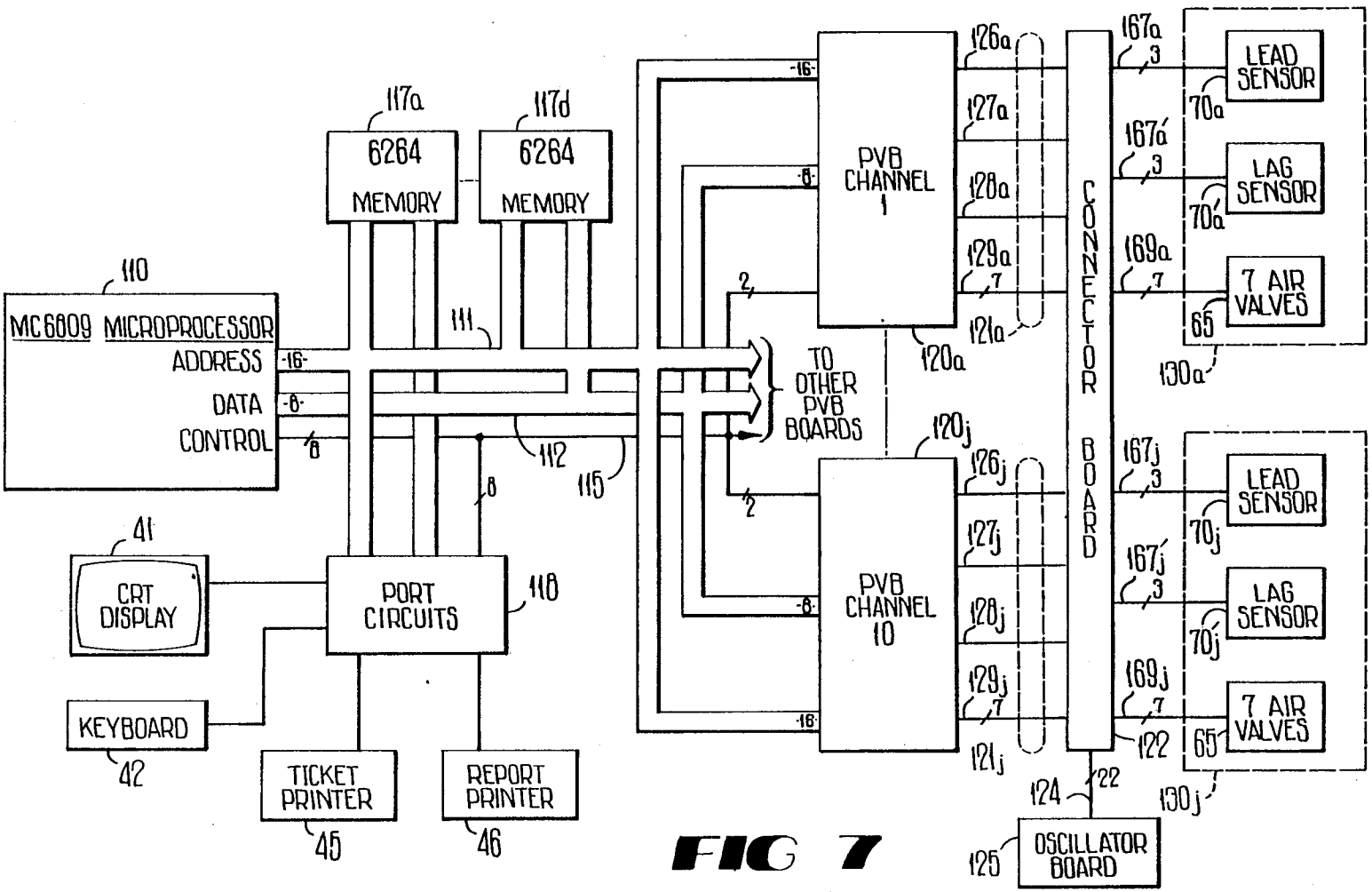
FIG. 7 is a block diagram of the controller and signature acquisition circuitry of the preferred embodiment.

FIG. 7 is a block diagram of the coin detection and signature acquisition circuitry of the preferred embodiment. The master controller for the preferred embodiment is built around a type MC6809 microprocessor 110. As is known to those skilled in the art, this microprocessor is a member of the 6800 family of microprocessors currently manufactured by Motorola Semiconductor Products, Inc. Details of bus signal timing, register capacity, and other familiar parameters of microprocessors for the MC6809 are well documented and known to those skilled in the art. The processor employs a 16 bit address bus shown as 111 and an 8 bit data bus 112. A multi-line control bus is shown as 115 is FIG. 7.

The preferred embodiment of the present invention uses memory mapped I/O to the signature detection apparatus. Therefore, the various digital signals constituting signature signals are located at particular logical addresses within the system memory. The decoding and driving circuitry necessary to implement a memory mapped data acquisition arrangement such as that of the preferred embodiment is commonplace, and no further details of same need be provided to understand the novel aspects of the construction and operation of the preferred embodiment.

In the preferred embodiment, system random access memory is embodied by four type 6264 random access memory chips shown as 117*a* through 117*d*. In the preferred embodiment, memory chips 117 are battery backed by conventional battery backup arrangements so that they are functionally nonvolatile. This allows the valid signature ranges obtained during the calibration process to be saved during periods of time in which the machine is turned off. As will be appreciated by those skilled in the art, embodiments of the present invention may be constructed in which saved calibration values are stored in other nonvolatile memory devices such as magnetic disks. It is well within the level of ordinary skill in the art to include a disk drive connected to the system for storing constants derived from a calibration process off-line for later use.

Bus circuits 111, 112, and 115 are shown as leading to block 118 labeled port circuits. These represent conventional computer ports, such as serial and parallel ports, for connecting the input/output devices of CRT display 41, keyboard 42 and printers 45 and 46, which are pictorially shown at console 40 in FIG. 1. The construction of such circuits is conventional.

The inventors of the present invention have recently constructed an alternate embodiment in which the representative port circuits 118 have been replaced by a single conventional serial port which is used to connect the apparatus of the preferred embodiment to a conventional small personal computer, such as an IBM PC XT. This allows a number of the maintenance, overhead, and report generating functions which were previously written in assembly language code and executed directly by microprocessor 110 to be moved off line. A set of simple instructions to the microprocessor to change operating parameters in the machine and to otherwise control same has been defined. Additionally, it allows the creation of a simplified syntax for communication between the controller and the serial port and allows the user to use higher level languages readily available for such small computers to more easily perform some of the report generating and ticket printing functions.

Moving to the right hand side of FIG. 7, a block diagram of the architecture of the preferred embodiment is shown. The address, data, and control buses are each tied to 10 proximity/valve boards (PVB) 120*a* through 120*j*, the first and last of which are illustrated on FIG. 7. Each of the PVBs is connected by a plurality of conductors 121*a* through 121*j*, which include a LEAD ENABLE signal provided through connector board 122 from oscillator board 125 on respective lines 126*a* through 126*j*. A group of 22 lines, shown collectively as 124, carries signals from oscillator board 125 to connector board 122. The LEAD SIGNAL is provided on a respective one of lines 127 from a respective one of lead sensors 70. A LAG SIGNAL is provided on a respective one of lines 128 from respective ones of lag sensor 70*a*′ through 70*j*′. Lastly, a group of seven lines 129 connects the air valve control outputs from each of the proximity/valve boards 120 to the seven air valves 65 associated with the channel controlled by the respective PVB. Therefore, for each PVB 120, lines 126 through 128 are inputs to the board and the seven air valve control lines 129 are the outputs.

It should be noted that only signal lines are illustrated on the controller and signature acquisition circuitry drawings in this disclosure. Except where otherwise noted, signal grounds, power supply conductors and the like are omitted for the sake of simplicity and readability of the drawing figures.

The sensors and valves associated with each channel, which are mounted on the surface of the drum as illustrated in FIG. 5, are shown as surrounded by dashed lines 130*a* through 130*j* in FIG. 7. Referring for a moment to FIG. 5, it should be appreciated that, for example, the seven air valves 65 shown within block 130*a* correspond to the left hand column of air valves associated with channel 1, as illustrated in FIG. 5. Thus, each group of air valves controlled by one of the proximity/-valve boards is a column of valves shown in FIG. 5, and constitutes the seven air valves controlled for an individual channel of the apparatus. Additionally, the groups 130 of sensors and valves illustrate the electronic and electromechanical components of the circuitry which are secured to the drum, as opposed to being located on printed circuit boards.

Figure 8A:
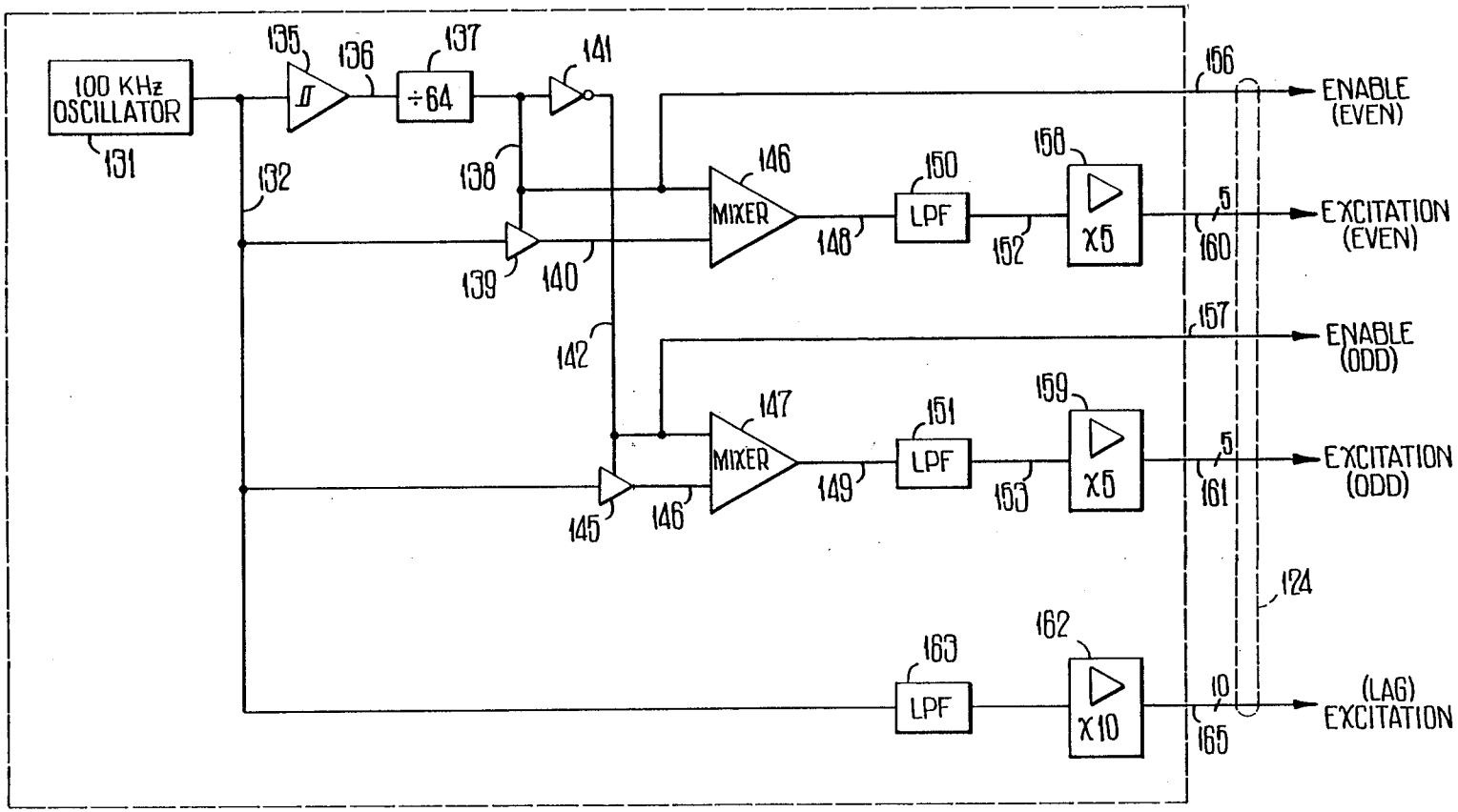
FIG. 8A is a circuit diagram of the oscillator board of the preferred embodiment.
Figure 8B:
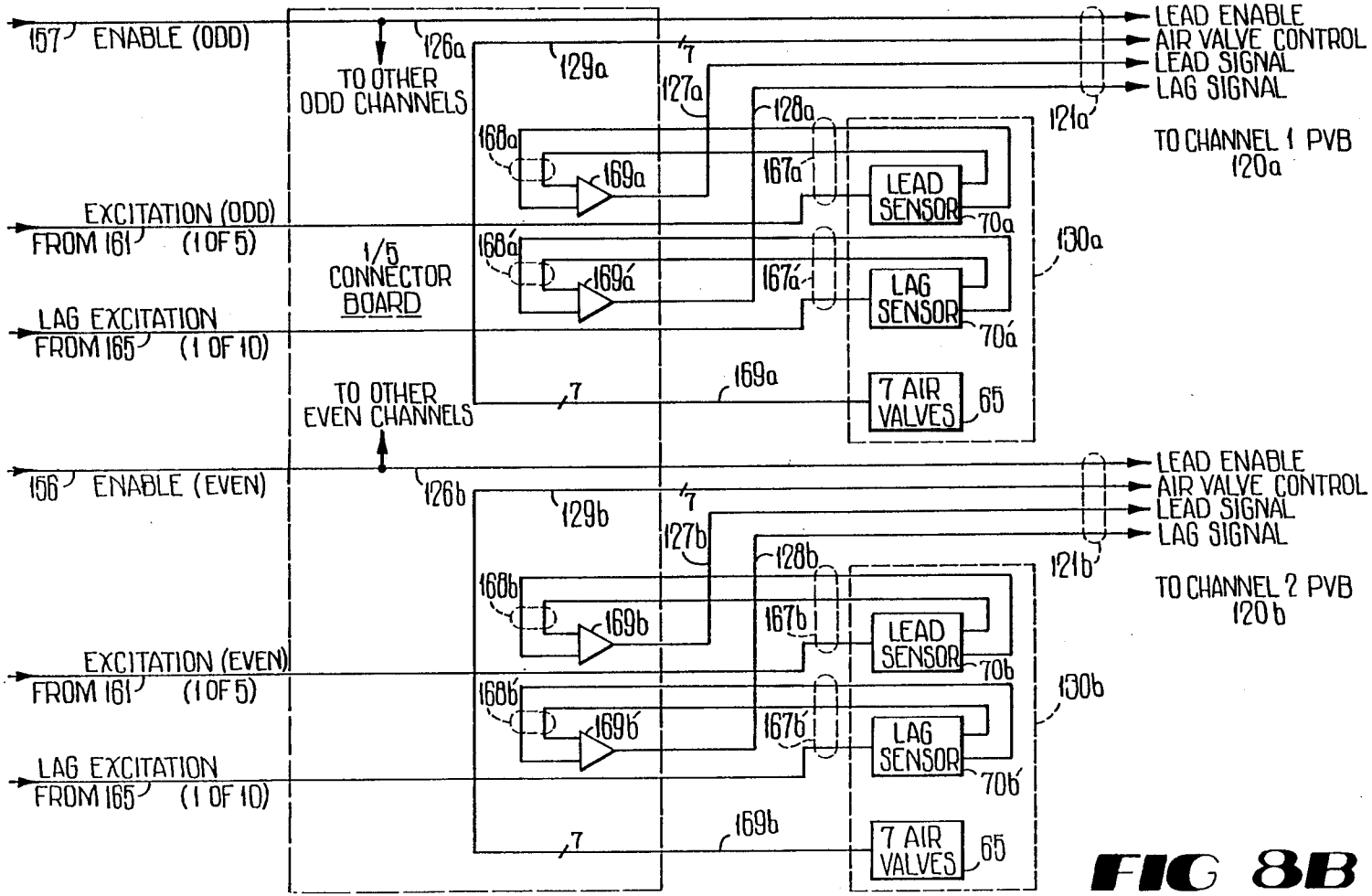
FIG. 8B is a circuit diagram showing a portion of the connector board of the preferred embodiment.
Figure 8C:
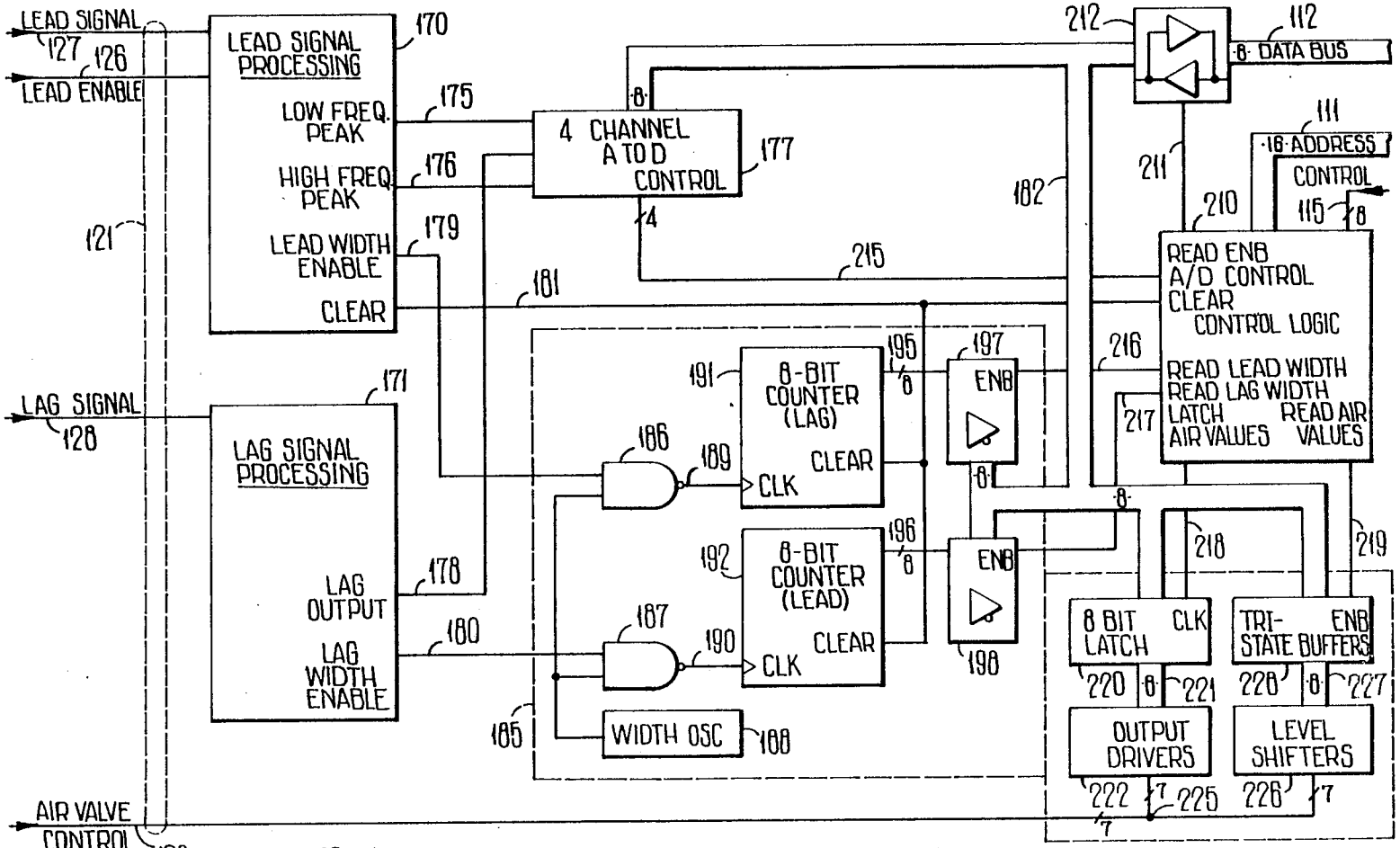
FIG. 8C is a block and circuit diagram of a representative one of the proximity/valve boards of the preferred embodiment.

Before proceeding with a more detailed explanation of the control and signature acquisition circuitry, the relationship of the drawing figures will first be described, so that the description may be understood in context. As noted above, FIG. 7 is a block diagram of the entire system. There are ten individual proximity/-valve boards 120 and ten individual collections of sensors and valves 130. There is a single connector board 122 and a single oscillator board 125 for the entire system. Details of the blocks shown in FIG. 7 are illustrated in FIG. 8 which consist of FIGS. 8A through 8E. First, FIG. 8A illustrates oscillator board 125. FIG. 8B shows details of connector board 122. FIG. 8C is a diagram of each of the proximity/valve boards 120. The lead and lag signal processing blocks of FIG. 8C are illustrated in further detail in FIGS. 8D and 8E, respectively.

With that in mind, the details of the other circuit elements of the preferred embodiment will be shown. Turning next to FIG. 8A, the master signal source for the system is shown in the illustration of oscillator board 125. The basic source of excitation signals in the preferred embodiment is 100 kiloHertz oscillator 131. It is important in the operation of the preferred embodiment of the present invention that oscillator 131 and the downstream circuits carrying output signals therefrom exhibit good amplitude stability. The output of oscillator 131 appears on line 132 which carries it as inputs to several other devices. First, a zero crossing detector 135 provides a square wave output on line 136 as the clock input to a counter chain 137 which performs a divide by 64 function. This provides a square wave output signal of approximately 1.56 kiloHertz on line 138.

First, the signal on line 138 is provided to the control input of an analog switch 139, the signal input to which is the 100 kiloHertz signal from line 132. This has the effect of gating the 100 kiloHertz signal from line 132 on and off of line 140 at the 1.56 kiloHertz rate of the signal on line 138. The signal on line 138 is inverted by inverter 141, the output of which appears on line 142 and is provided to the control input of a second analog switch 145, the signal input of which also carries the 100 kiloHertz signal from line 132. The output from analog switch 145 appears on line 146. It will therefore be understood that line 146 likewise carries bursts of the 100 kiloHertz signal, the bursts being at the 1.56 kiloHertz rate. Due to the action of inverter 141, the output on line 140 will pass the signal from line 132 when the output on line 138 is held high. During the opposite states of line 138, line 146 will carry the signal from line 132 and line 140 will be held low. The signals on lines 138 and 140 are inputs to a mixer 146 and the inputs from lines 142 and 146 are inputs to mixer 147. The outputs of the respective mixers appear on lines 148 and 149 as the inputs to low pass filters 150 and 151, respectively. The outputs from low pass filters 150 and 151 appear on lines 152 and 153, respectively. Also, the asserted and negated versions of the 1.56 kiloHertz signal on line 138 are provided on lines 156 and 157, respectively.

From the foregoing, the following should be appreciated. The outputs on line 152 and 153 each carry a low pass filtered output of a mixed signal from the 100 kiloHertz oscillator 131 and the 1.56 kiloHertz signal output from divider 137. While both of these signals are mixed outputs of these two frequencies, it should be appreciated that the 100 kiloHertz component is suppressed on line 152 when it is present on line 153, and vice versa. It should further be appreciated that when the ENABLE (EVEN) signal on line 156 is active, the 100 kiloHertz component from oscillator 131 will be present on line 152. When the ENABLE (EVEN) signal on line 156 is inactive, this signal component will be absent from line 152. However, under these circumstances, the ENABLE (ODD) signal on line 157 will be active and 100 kiloHertz component will be present on line 153. This is the source of the alternate excitation (with a high frequency signal component) of the staggered rows of lead sensors described hereinabove in connection with FIG. 5. The outputs on lines 152 and 153 are provided, respectively, to five driver amplifiers shown as 158 and 159 in FIG. 8A. These provide five lines carrying identical even and odd excitation signals are shown collectively as 160 and 161 in FIG. 8A. Amplifiers 158 and 159 are provided to give adequate drive and isolation to the sensors.

The output from oscillator 131 on line 132 is also provided to a low pass filter 163, the output of which is provided to ten driver amplifiers shown as 162 in FIG. 8A. The output from these drivers is provided on a collection of ten lines 165 to give the LAG EXCITATION signal to each of the ten lag sensing coils **70*a*' through 70*j*'. It will therefore be appreciated that, in the preferred embodiment, only the output from 100 kiloHertz oscillator 131** is used to excite the lag coils, since their primary purpose is simply to detect the presence or absence of a coin as each counterbore passes a lag sensing coil.

Turning next to FIG. 8B, details of connector board 122 (FIG. 7) are shown. The lines entering the drawing from the left hand side of FIG. 8B are the signal lines provided from oscillator board 125 illustrated in FIG. 8A. On the right hand side, collections of lines **121*a* and 121*b* are shown for the proximity/valve board (FIG. 7) 120*a* and 120*b*** for the first two channels.

The components on connector board 122 are shown surrounded by dashed line 122 in FIG. 8B. Note that the connections for one fifth of the connector board are shown. Therefore, the circuitry shown on FIG. 8B will be duplicated four additional times on the complete connector board 122. The connections for the first two channels are shown to illustrate the connection of exemplary odd and even numbered channels to the signals from oscillator board 125. FIG. 8B is essentially self-explanatory and will only be discussed briefly. First, the ENABLE EVEN and ENABLE ODD signals on lines 156 and 157 from the oscillator board are connected directly through the board to respective lines **121*b* and 121*a* for channels 2 and 1, respectively. As shown on the drawing, the enable signals from lines 156 and 157 are provided to the other respective even and odd channels on the connector board. An explanation of the connections for the odd numbered channel 1 will be sufficient to explain the operation of the other channels. One of the five lines from group 161 (FIG. 8A) is provided directly to lead sensor 70*a* mounted over the drum. The extension of the line from 161, and the two output lines exiting lead sensor 70*a* form the group of three lines 167*a* illustrated in FIGS. 8B and 7. A pair of these lines, shown as 168*a*, is provided as an input to instrumentation amplifier 169*a*. As illustrated in FIG. 8B, the instrumentation amplifiers 169 reside physically on the connector board. In keeping with the notation adopted elsewhere in this specification, reference numerals followed by letters a through j refer to like components for channels 1 through 10**, respectively. Within such subsets, any number which adds a prime (') to circuitry associated with the sensors references an element associated with the lag sensor for that channel.

The output from instrumentation amplifier **169*a* is provided on line 127*a* (part of group 121*a*) as the LEAD SIGNAL signal line provided to proximity/valve board 120*a* shown in FIG. 7**.

Similarly, the LAG EXCITATION signal from group 165 is provided to lag sensor **70*a*', the output of which is amplified by instrumentation amplifier 169*a*' and provided on line 128*a* to the channel 1 PVB. The seven air valve control lines 129*a* for channel 1 are connected, through connector board 122, directly to the group of seven lines 169*a***.

The connections for the even numbered channels, including channel number 2 illustrated on FIG. 8B, are identical except for the particular sensors and valves associated with the particular channel to which the connections are made, and the fact that the even enable and excitation signals are used. Similarly, the connections through connector board 122 for the remaining channels are the same as those illustrated in FIG. 8B.

Turning next to FIG. 8C, a diagram of one of the proximity/valve boards 120 is illustrated. FIG. 8C represents an exemplary PVB for one of the channels. Therefore, the notation a through j indicating a particular channel has been omitted from the reference numerals on FIG. 8C. The signals for line group 121 are shown entering the board at the left hand side. The connections to buses 111, 112, and 115 are shown at the right hand side of the diagram.

The LEAD ENABLE signal on line 126 and the LEAD SIGNAL output on line 127 from the associated lead sensing coil are provided as inputs to lead signal processing block 170. The LAG SIGNAL on line 128 is provided as an input to lag signal processing block 171. Details of the circuitry within these blocks are described hereinbelow in connection with FIGS. 8D and 8E, respectively. For purposes of discussing FIG. 8C, the following description of the outputs from signal processing blocks 170 and 171 will suffice. Low and high frequency peak signals appear as analog voltages on lines 175 and 176, respectively. These are provided as two inputs to four channel analog-to-digital converter 177. A lag output signal is provided on line 178 to another input to A-to-D converter 177. Width enable signals for the lead sensors and lag sensors appear on lines 179 and 180 from signal processing blocks 170 and 171, respectively. Lastly, a clear signal is provided as an input on line 181 to lead signal processing block 170.

As will be explained in greater detail in connection with FIGS. 8D and 8E, low and high frequency peak signals on lines 175 and 176 provide the signature signals consisting of the peak of the amplitude of the low frequency content from the LEAD SIGNAL on line 127 and the high frequency signal content from the same lead. Thus, the signals on lines 175 and 176 are low and high frequency peak amplitude signals forming part of the signature of the coin passing the coil to which line 127 is connected.

The lead and lag width enable signals on lines 179 and 180 are the outputs of threshold detectors which go high when the input signals on lines 127 and 126 are above a threshold magnitude, after appropriate filtering and rectification. The peak signals are converted to 8 bit digital values by analog-to-digital converter 177 which are provided to PVB 8 bit data bus 182 for reading by the system at appropriate times.

The width enable signals on lines 179 and 180 are provided as inputs to the width measuring circuits shown as surrounded by dashed lines 185. The width enable signals on lines 179 and 180 are provided as one input to each of respective NAND gates 186 and 187. The other inputs to these gates are from width oscillator 188. The outputs from NAND gates 186 and 187 are provided on lines 189 and 190, respectively, to the clock inputs of lead width counter 191 and lag width counter 192. It is apparent from inspection of FIG. 8C that the lead and lag width enable signals on lines 179 and 180 alternately enable and disable counting by counters 191 and 192, since they alternately gate the clock signal from width oscillator 188 on and off. Thus, when the lead width enable signal on line 179 goes high in response to a rising magnitude of the lead signal on line 127, lead width counter 191 will begin counting until a decline in the lead signal magnitude on line 127 reaches a point which causes the lead width enable signal to go low. Therefore, the values stored in counter 191 will correspond to the time that the lead width enable signal was high. As will be apparent from the explanation of FIG. 8D, this corresponds to the time during which the magnitude of the high frequency component of the signal on line 127 was above a predetermined value as an object passed the particular one of lead sensor coils 70 to which line 127 is connected. Naturally, the count stored in counter 192 after it has been allowed to acquire a count represents the width of the lag signal.

The 8 bit outputs from counters 191 and 192 appear on respective sets of eight lines 195 and 196 as inputs to tristate buffers 197 and 198.

As noted hereinabove, the signature acquisition circuitry for the proximity/valve boards 120, as shown in FIG. 8C, are all part of memory mapped I/O address space for the system memory. The signature components include low and high frequency peak signals from the lead sensing coil which are converted to 8 bit numbers by A-to-D converter 177, and the leading width signal provided as a count output on lines 195. Additionally, the lag detector signature is provided only as a width signal in the form of an 8 bit number which appears on lines 196. All of the signature values are applied, at appropriate times under the control of microprocessor 110 (FIG. 7) to PVB data bus 182 for reading on to system data bus 112. Control logic block 210 is simply an implementation of well known address and read request control logic for reading the data values of particular logical addresses of system memory. Implementation of circuitry to generate the functions of control logic block 210 will be apparent to those skilled in the art. A bus control signal appears on line 211 as a control signal to bidirectional bus driver 212 which interfaces system data bus 112 to PVB data bus 182. Four control lines, shown as 215 in FIG. 8C control analog-to-digital converter 177. The clear output from block 210 appears on line 181 and is provided to signal processing blocks 170 and to the clear inputs of counters 191 and 192. Thus, when processor 110 issues an instruction to write to the particular address associated with the clear function, line 181 goes high causing clearing of all the signature values stored in the above referenced circuits.

Separately decoded signals for reading the lead width signature and the lag width signature are provided on lines 216 and 217, respectively. These control the tristate inputs to tristate buffers 197 and 198 connecting the outputs from counters 191 and 192 to PVB data bus 182 at appropriate times under the control of the microprocessor. Naturally, when data is being read from the proximity/valve board 120, line 211 controls bidirectional bus driver 212 to transmit data from PVB bus 182 to system data bus 112.

From the foregoing, it should be clear that the peak and width signature values are acquired by the circuitry on the proximity/valve boards 120, as shown in FIG. 8C. These values are read on to system data bus 112 under the control of microprocessor 110 (FIG. 7). Analysis of the signature signals takes place under the control of the microprocessor, based on stored calibration values in system memory. When this is accomplished, the microprocessor writes signals back to each proximity/valve board 120 to control the associated column of solenoid operated air valves in a sequence which will be described in greater detail in connection with FIGS. 10 and 11. Suffice it to say that two decoded outputs from control logic block 210 are provided on lines 218 and 219 for latching outputs to the air valves for the channel controlled by exemplary board 120 shown in FIG. 8C, and for reading the states of those valves. When an 8 bit word (7 bits of which are used to control the valves) is to be written to the valves, the word appears on system data bus 112 and is connected to PVB data bus 182. A transition of the appropriate sense is then made in the signal on line 218 to clock an 8 bit latch 220, thus latching the valve control word into this device. The outputs of the latch appear on eight lines shown as 221 and are provided as the inputs to output driver 222, which provides sufficient electrical drive to operate the solenoids associated with the air valves.

Additionally, information on the states of the valves can be read by the system. The group of 7 air valve control lines 129 is connected at point 225 to the outputs of drivers 222 and to the inputs of level shifters 226. The level shifters convert the signal levels used to drive the solenoids to appropriate logic levels which appear as outputs on lines 227. These are provided as inputs to tristate buffers 228. When the microprocessor writes to the address associated with control line 219, tristate buffers 228 are activated to connect the output on lines 227 to PVB data bus 182 so that information about the current states of the valves may be read. This information is used to detect inoperative valves and assure that proper outputs are being provided by the system for a given state into which it is trying to place the valves.

In summary, the data for the peak value and width value signatures is all read on to system data bus 112 from the devices shown in FIGS. 8C. Valve control words are written from system data bus 112 into latch 220 to control the 7 air valves associated with each particular channel. Additionally, certain self-testing and calibration information is provided by the preferred embodiment, including the valve state reading apparatus associated with level shifters 226 and the lag signal output on line 178.

Figures 8D, 8E:
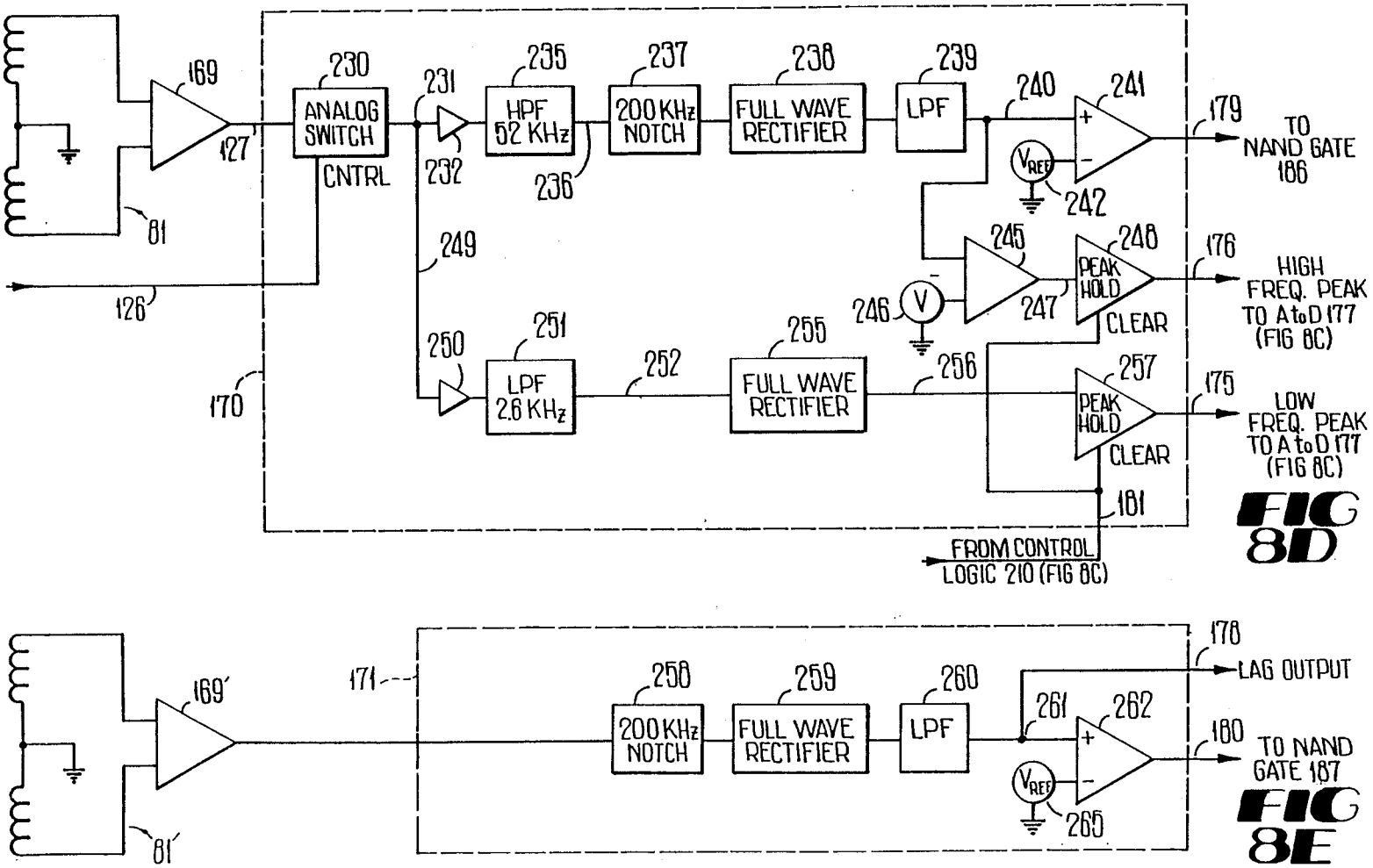
FIG. 8D is a block diagram of the analog circuitry of the signature detection apparatus of the preferred embodiment.
FIG. 8E is a block diagram of the proximity detector circuits of the lag sensors of the preferred embodiment.

FIGS. 8D and 8E show details of the lead and lag signal processing circuitry for blocks 170 and 171 of FIG. 8C. Turning first to FIG. 8D, the elements shown surrounded by dashed line 170 constitute the elements of the lead signal processing circuit. The output from an associated instrumentation amplifier 169 connected to the lead sensor of the particular channel serviced by the PVB appears on line 127. The lead enable signal appears on line 126 as the control input to an analog switch 230. It should be recalled from the discussion of oscillator board 122 (FIG. 8A) that line 126 is active when the lead sensor excitation signal contains bursts of the 100 kiloHertz higher frequency signal of the preferred embodiment. Therefore, analog switch 230 alternately passes signal from line 127 to point 231 in the signal path of the lead signal processing apparatus.

From point 231, the signal is processed for high frequency content by the circuitry shown on the upper portion of circuit 170 and for low frequency content by the elements in the lower part of the figure. Proceeding first with the upper portion, the signal at point 231 is buffered by an amplifier 232 and passes through a high pass filter 235 having a cutoff frequency of 52 kiloHertz. The output from the high pass filter appears on line 236 where it is provided as input to a 200 kiloHertz notch filter 237 which removes any second harmonics of the 100 kiloHertz high frequency excitation signal. The output from this filter is rectified by full wave rectifier 238 and the output thereof is sent through low pass filter 239 where it appears as an output on line 240. From the foregoing, it will be appreciated that filter 235 attenuates any low frequency components in the signal from point 231, and the combination of rectifier 238 and low pass filter 239 provides a signal output on line 240 indicative of the magnitude of the high frequency content of the signal entering the processing apparatus on line 127.

The signal on line 240 is used to generate both the peak signature signal and the width signature signal of the preferred embodiment. The output on line 240 is provided as an input to comparator 241, the other input of which is connected to reference voltage source 242. Reference voltage source 242 sets the trigger level for width counter 191 (FIG. 8C) and thus serves to define a predetermined threshold value for the definition of the width of the pulse which will appear at point 240 in response to a metallic object passing the lead sensor. The output from comparator 241 appears on line 179 and controls the width counter as described hereinabove in connection with FIG. 8C.

The signal from line 240 is also provided as the input to a summing amplifier 245, the other input of which is connected to negative reference voltage source 246. Reference source 246 is selected to be negative in order to expand the dynamic range of the output signal on line 247 to take advantage of the full scale of analog-to-digital converter 177 (FIG. 8C). The output on line 247 is provided to a conventional peak hold circuit 248 which acquires and holds the peak value of the signal on line 247 and applies same on line 176 as the HIGH FREQUENCY PEAK signal provided to A-to-D converter 177.

The signal from point 231 is also provided on line 249 as an input to a buffer amplifier 250, from which it passes to a 2.6 kiloHertz low pass filter 251. The output from this filter appears on line 252, and is rectified by a second full wave rectifier 255 whose output appears on line 256. The signal from line 256 is provided as the input to a second peak hold circuit 257 which retains the peak value of the signal on line 256 on line 175, which provides same to the analog-to-digital converter 177 (FIG. 8C).

Whenever control logic 210 (FIG. 8C) puts an active clear signal on line 181, the outputs from peak hold circuits 248 and 257 are reset to zero in preparation for the occurrence of the next pulse.

The lag signal processing circuit 171 is shown in FIG. 8E. It simply includes 200 kiloHertz notch filter 258 which performs the same function as filter 237 in the lead signal processing circuit. The output from this filter is rectified by a full wave rectifier 259, the output of which is low pass filtered by filter 260 to provide a signal at point 261. Keeping in mind that the lag coil connected amplifier 169' is excited only by the 100 kiloHertz signal from the oscillator board, the signal on point 261 will be understood to be a positive voltage indicative of the magnitude of the detected signal from the lag sensor. During normal operation, the signal from line 261 is provided as one input to a comparator 262, the other input of which is connected to reference voltage source 265. This combination serves the same threshold setting function as comparator 241 and reference source 242 serve in lead signal processing circuit 170. Thus, the output from the comparator which appears on line 180 is used to control lag width signature counter 192 (FIG. 8C) in the same manner.

The signal from point 261 is also provided to line 178 as the lag output signal which in turn is provided to A-to-D converter 177 (FIG. 8C). As discussed in connection with FIG. 8C, this signal is used during calibration and testing of the apparatus but is not, in the preferred embodiment, used to generate a signature signal during normal operation.

As noted hereinabove, and as will be apparent from inspection of FIG. 8D, only the peak value for the low frequency channel of lead signal processing circuitry 170 is used in the preferred embodiment although width values could also be used in connection with coinage systems requiring a fourth signature signal to reliably discriminate among members of the system.

Figures 9, 10, 11A, 11B, 11C, 11D, 11E:
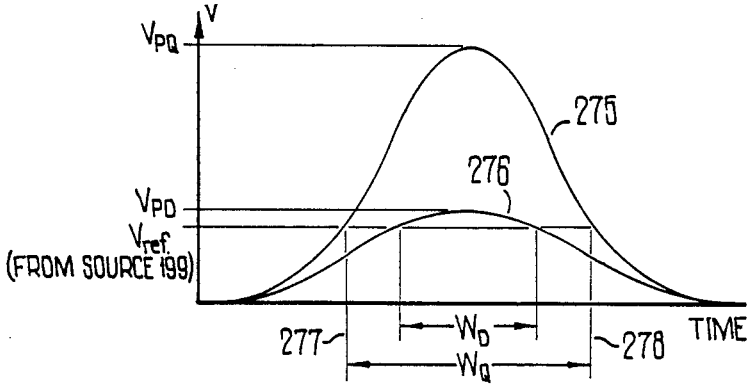
FIG. 9 is a graphic representation of output voltages of the signature signals used in the preferred embodiment.
FIG. 10 is a diagram depicting particular memory locations and the coin ejection queue of the memory of the preferred embodiment.

FIG. 9 represents typical peak and width values for the high frequency channels for United States quarters and dimes, respectively. The curve shown as 275 represents the output signal on line 240 in response to a quarter passing one of the sensing coils. The curve labeled 276 represents the signal level on line 240 (FIG. 8D) in response to the passage of a U.S. dime. The voltage level indicated as $v_{ref}$ on FIG. 9 represents the reference voltage established by source 242 shown on FIG. 8D. It should be understood that the curves represented in FIG. 9 are exemplary only and the actual curves generated by coins can vary widely in shape. Additionally, various additional curves will be generated for other objects, such as tokens and foreign coins, which the apparatus of the present invention can reliably detect and identify.

Considering the case of the quarter for a moment, it will be appreciated that a substantial voltage output curve is provided in response to the passage of a quarter under one of the sensors. The quarter signal crosses the reference voltage at a time indicated at dashed line 277. It continues to rise until it reaches a peak voltage represented as $v_{pq}$ on FIG. 9. The signal then begins to drop as the quarter moves on past the sensor until it falls below the reference voltage at a time indicated by dashed line 278 on FIG. 9. Therefore, the time the signal is above the reference voltage is the quarter width signal shown by dimension line $W_q$ on FIG. 9 and this corresponds to the count obtained by counter 191 (FIG. 8C).

The corresponding curve for the U.S. dime is less sharp and has a lower peak value. Thus, the peak value $V_{PD}$ is significantly lower. As a result, the period of time during which the signal is above the reference voltage is correspondingly lower and is represented by period $W_D$ shown in drawing FIG. 9. Again, this represents a count obtained by counter 191 when enabled by the output of NAND gate 186 (FIG. 8C).

Naturally, it will be understood by those skilled in the art that processor 110 is kept rather busy. In the preferred embodiment, the time between passage of adjacent counterbore centers past a given point is on the order of 93 milliseconds. The channel clear signals can all be issued on line 181 substantially simultaneously for all of the channels since all PVBs decode the same signal as a clear. Thus, once the peak and width values have been cleared, the following should be apparent from the foregoing description. First, both the peak and width detection apparatus operates asynchronously with respect to the master timing source controlling microprocessor 110. Thus, once the last acquired signal levels are cleared, the next set of peak and width value signals will be automatically acquired by the circuitry shown on FIGS. 7 and 8 without further assistance by or attention from microprocessor 110.

Data is read at substantially the time at which the center point between two adjacent counterbores on a given channel is passing under the lead sensors. Due to the speed at which microprocessor 110 can read data from its data bus, the machine sequentially polls the ten channels, in a short period of time, to acquire the signature signals from the last row of ten counterbores passing the lead coils. Once these are stored, it need only issue appropriate clear signals to reset the signature acquisition apparatus to its initial conditions in preparation for the approach for the next row of counterbores. In the meantime, microprocessor 110 compares the signature values obtained to the stored calibrated values, and determines the denominations of the coins for each channel for the counterbore row which just passed the sensors. When this is accomplished, appropriate output signals are provided into a memory queue to control the operation of solenoid operated air valves 65 as the particular counterbores just analyzed pass under the air valve array. Once this is accomplished, the microprocessor is ready to read the next set of 30 signature signals (three from each channel) and proceed to process the data for the next row of counterbores.

Once the coin denomination has been determined, it is appropriate to be able to output a signal which will control ejection of the coins from the counterbores in a manner such that the microprocessor does not need to concern itself further with the relative positions of the coins as they pass over the coin receiving stations shown in FIGS. 3 and 6. However, it should be noted that the sequence of coin denominations in adjacent counterbores of the same channel is random. Since the coin receiving stations are spaced apart by the distance between adjacent counterbores, but there is not preknowledge of the order in which coins of particular denominations will appear, it is quite apparent that it is possible for a coin which is physically behind another, that is, in an upstream counterbore with respect to the sense of rotation, to require ejection before the downstream coin. In other words, coins may be ejected "out of order" with respect to their movement past a predetermined point on the sensor array.

To simplify the work of the microprocessor as much as possible, the present inventors have created an queuing system for controlling coin ejection by the air valves. For each channel, a 7 bit word is defined in machine memory which is manipulated logically to operate as seven parallel shift registers. The coin ejection memory queue is implemented by giving the machine access to one of 7 bits in response to each coin detected. However, one and only one particular bit of each of the 7 words may be set, depending on the denomination of the coin detected.

To understand the operation of this, reference is made to FIGS. 5, 10, and 11A through 11E. FIG. 10 shows the logical structure of the coin ejection memory queue using four of the seven shift registers as an example. Five words labeled $N_0$ through $N_4$ are shown. At the top, are the letters Q, N, P, and D which represent quarter, nickel, penny, and dime, respectively. As the drum physically rotates, the words are logically shifted in a downward direction. Therefore, this memory queue structure may be thought of as four parallel shift registers, one for each coin denomination. In the full 7 bit wide memory queue of the preferred embodiment, two of the remaining shift registers (not shown in FIG. 10) are devoted to the two other coin receiving stations 58 (FIG. 3) and the last shift registers devoted to unknown values which will be ejected back into the interior of the drum. During conventional use, one of the shift registers associated with the coin receiving station will be used for off sort items. The left hand bit of each word appears under the "Q" column and thus this column represents a shift register which controls the air valve which ejects coins into the quarter coin receiving station. Turning to FIG. 5 for a moment, the right most bits shown in FIG. 10 in the "Q column" will always be used to activate, or fail to activate, the air valve in this particular channel which appears on row 61*d* in FIG. 5. Similarly, the next column proceeding to the right is the nickel column and the bits in this column will activate the air valve for this channel which appears on row 61*c*. In a similar manner, the "P" column bits control the air valve on row 61*b* and the "D" column bits control the air valve on row 61*a*.

The notation on FIG. 10 indicates that all valves are read as the output of word 0 each time a new set of counterbores becomes centered over respective ones of the coin receiving stations.

The diagonal set of letters, Q, N, P, and D shown in words $N_4$ through $N_1$ represent the particular bit which will be set in response to detection of coin denomination. As noted on the left hand side of FIG. 10, once the coin denomination has been determined by the sensor, one and only one of these 4 bits will be set, assuming that a valid coin of one of these four denominations is detected. Therefore, if for any given counterbore, a quarter is detected, a 1 will be placed in the left most bit of word $N_4$ where the letter "Q" appears in the drawing. If, instead, a penny was detected, the second most significant bit of word $N_2$ would have been set and the remaining bits in words $N_1$ through $N_4$ would remain unchanged (i.e., as zeroes).

From inspection of FIG. 10, it follows logically that the sensing coil is, both physically and temporally, located one intercounterbore distance away from the rank of dime ejecting air valves. In the preferred embodiment, this will hold true for coils **70*b*, 70*d* . . . through 70*j*. However, it will be fully appreciated that the queue can be constructed, will operate properly, for sensors which are further upstream simply by increasing the number of words between the $N_1$ through $N_4$ set which may be manipulated by the microprocessor, and the word corresponding to $N_0$ at which all valves are read. Thus, one extra word will appear in the queue between the nibble which is read and the four $N_1$ through $N_4$ words for the channels using sensor 70*a*, 70*c* . . . 70*i***.

To understand the operation of this coin ejection memory queue, a particular example will be used in connection with FIGS. 11A through 11E. The particular example assumes acquisition of data for a first counterbore containing a quarter, followed by a counterbore containing a penny. During this discussion, reference will be made to FIG. 5 to correlate the logical manipulation of the coin ejection memory queue with physical movement of the drum past the sensors and under the air valve array.

In FIGS. 11A through 11E, X's in the memory location represent don't known conditions which were set by the microprocessor in response to previously detected coins. This is to help focus the operation of the queue on the two coins which form this example. The state of the memory queue in FIG. 11A is shown at time $T_1$. A quarter has been detected and therefore the left most bit of word $N_4$ is set to 1 and the other three bits on the diagonal of possible bits to be set are left as zeros. Thus, in response to the detection of a quarter, the bit sequence 1000 is written on the diagonal through the four words $N_1$ through $N_4$.

When the contents of the next counterbore has been detected, all four logical shift registers of the coin ejection queue have been shifted downward by one and the microprocessor will set one of the diagonal bits in response to the detection of the penny. As may be seen from inspection of FIG. 11B this gives the expected logical bit pattern on the diagonal of 0010 corresponding to detection of the penny. The previous 1000 diagonal has been shifted downward one bit, and the four don't know conditions which were at read word $N_0$ at time $T_1$ have been shifted out. At time $T_2$ the first bit from the example arrives at read word $N_0$. This is the zero bit in the dime shift register. This indicates that the dime solenoid will not be activated for this channel at time $T_2$.

Turning to FIG. 5, and again assuming that the present example is for sensor coil **70*b* spaced one counterbore distance from dime air valve row 61*a*, it will be appreciated that this is the proper system response. Since a quarter was detected at time $T_1$, and it has moved one counterbore position at time $T_2$, this quarter is, at time $T_2$, located under the dime air valve on row 61*a*. Therefore, the zero which appears in the right most bit of word $N_0$ at time $T_2$ (FIG. 11B**) is appropriate.

Another coin is read, the counterbores move one position, and time $T_3$ arrives. The state of the memory queue at time $T_3$ is shown in FIG. 11C. Note, that another diagonal bit set will be written at time $T_3$ but is not shown in the drawing figures, again to focus on the response of the machine to the two coins of the example. At time $T_3$, both the penny and dime air valves are responding to zeros which were placed in the queue as a part of the example. Again, turning to FIG. 5, it will be understood that this is appropriate by considering the sequence already described. At time $T_3$, the quarter will have advanced to row **61*b* and will therefore be over the penny coin receiving station. The penny, one counterbore behind, will have advanced over the dime coin receiving station and will be under the valve on row 61*a***. Therefore, the two zeros which have resulted from detection of the two coins in the example give the correct result.

Again, another shift takes place and the bit pattern 001 now appears as the three left most bits of read word $N_0$. It will be apparent that, whenever a 1 appears at a given bit position in word $N_0$, a corresponding air valve is to be activated. At time $T_4$, the penny shift register is the one which has the 1 at word $N_0$.

Once again returning to FIG. 5, it will be appreciated that, at time $T_4$ the quarter has advanced to row 3 and is thus over the nickel coin receiving station. Therefore, the zero in the nickel column of the coin ejection memory queue is appropriate. However, the penny of the example is one counterbore behind and is now over the penny coin receiving station. FIG. 11D indicates that a 1 is present in the read word for the penny shift register and, in fact, the air valve from row **61*b*** for this particular channel will be activated ejecting the penny into the penny coin receiving station.

Lastly, we come to one more shift of a counterbore position at time $T_5$, which is illustrated in FIG. 11E. In FIG. 11E, a 1 appears in the read word for the quarter column and indeed, between times $T_4$ and $T_5$, the quarter has advanced from its position over the nickel coin receiving station to one over the quarter coin receiving station. Therefore, the valve for this channel on row **61*d*** is activated and the quarter is ejected into the appropriate coin receiving station.

From the foregoing, it will be apparent that the detected coin values are translated into a diagonal bit pattern in the coin ejection memory queue in which one and only one bit of the diagonal pattern is set in response to detection of any given coin. It should further be noted from inspection of FIGS. 11A through 11E, physically, the quarter preceded the penny by one counterbore position. However, since the penny coin receiving station is two counterbore positions upstream from the quarter coin receiving station, the penny was ejected first, at time $T_4$.

From this it should be appreciated that, once a coin value is determined for a given channel, microprocessor 110 need only write the appropriate diagonal bit pattern into the coin ejection memory queue and it need concern itself no further with keeping track of what coin is where, other than to implement the steps necessary to perform the very simple shifting function required to operate the queue.

As noted hereinabove, the present apparatus lends itself quite readily to self-calibration. The apparatus can be placed in a calibrating mode of operation under control from the console 40 (FIG. 1). When in this mode of operation, a representative sample of a collection of know objects, for example, United States quarters or bus tokens from a particular transit system, are loaded into the drum of the preferred embodiment. The apparatus is turned on and proximity/valve boards acquire sets of the two peak and one width signatures as described hereinabove in connection with its sorting and counting mode of operation. Naturally, if the coinage system at hand appears to acquire the use of additional signature signals, same can be defined for such a system in embodiments of the present invention.

During the calibration mode of operation, each acquired signature value for each individual counterbore location 51 within the drum is stored in memory 117 (FIG. 7). Each new acquired signature value for that particular counterbore is compared to then current maximum and minimum stored values and, if greater than the maximum or less than the minimum, the new value replaces the old.

Furthermore, during the calibration mode of operation, the solenoid operated air valves on row 61g (R7 in FIG. 5) are activated to return each of the objects to the interior of the drum. This causes a random mixing of the objects and will cause, at various times during the calibration operation, the same object to be detected by different ones of the sensing coil 70 in different particular ones of the counterbore locations. In this way, an excellent statistical sample of the response of a given machine embodying the present invention to a representative sample of known objects of particular type is obtained in data stored for the valid set of signature signals. As noted hereinabove, this can be stored in any form of nonvolatile memory including off-line devices.

Naturally, when calibrating the system to detect members of a particular coinage system, the machine must be calibrated in the above described manner with respect to each member of the set of the coinage system. When this accomplished, a large number of variables within the machine, which can vary significantly among different counterbore locations sensing coils 70, but which parameters do not vary significantly over time for a given machine, are all accounted for during calibration.

It will further be apparent that the apparatus is readily adaptable to changes in the coinage system that needs to be handled by any operator. For example, if some form of token needs to be detected, it need only be loaded in and the machine calibrated for same. Naturally, various ones of coin receiving stations 56 can be defined to receive those coins during any subsequent operation by simple operations at keyboard 42 (FIG. 1). Likewise, the machine is readily adaptable, through the calibration process, to other changes in coinage, such as governmental changes in alloy content in order to save minting costs.

The foregoing has been a full and complete description of the preferred embodiment of the present invention. From this description it will be appreciated that the present invention overcomes the drawbacks of the prior art noted hereinabove and also accomplishes the object of the present invention previously recited. From the foregoing description, many variations and equivalent structures will suggest themselves to those skilled in the art and therefore the scope of the present invention is to be limited only by the claims below.

We claim:

1. A sensor for identifying members of a predetermined set of metallic objects, each object of said predetermined set of objects being characterized by a predetermined metallic content and a predetermined geometry comprising in combination:

a transformer coil having a primary winding and a secondary winding;

moving means for causing relative movement of members of said predetermined set of metallic objects, one at a time, and said transformer past each other at substantially a predetermined constant velocity;

signal generating means for exciting said primary winding with an electrical signal having at least two distinct first and second frequency components;

signal processing means connected to said secondary winding for processing output signals from said secondary winding into a first signature signal responsive to said first frequency component in said output signals and a second signature signal responsive to said second frequency component in said output signals;

said signal processing means including means for rectifying said output signals from said secondary winding containing said first frequency component to provide a first rectified output signal, holding means for detecting and storing a first peak value of said first rectified output signal, and width measuring means for measuring a first time period during which said first rectified output signal has a magnitude exceeding a first predetermined magnitude and for providing a first width value in response thereto, said first signature signal comprising said first peak value and said first width value;

means defining a predetermined set of object identification output signals having at least one member corresponding to each member of said predetermined set of objects and at least one member corresponding to an unknown object; and means connected to said signal processing means for providing one of said object identification output signal conditions in response to said first signature signal and said second signature signal.

2. A sensor as recited in claim 1 wherein:

said signal processing means includes means for rectifying said output signals from said secondary winding containing said second frequency component to provide a second rectified output signal, said holding means is responsive to said second rectified output signal to detect and store a second peak value of said second rectified output signal; and said second signature signal comprises said second peak value.

3. A sensor as recited in claim 1 wherein:

said moving means includes means for holding said transformer at a predetermined location in a predetermined orientation above a predetermined path carrying said metallic objects past said transformer.

4. A sensor as recited in claim 3 wherein:

said transformer is characterized by a longitudinal axis about which said primary and secondary windings are wound;

said predetermined orientation is characterized by said longitudinal axis being perpendicular to said predetermined path carrying said metallic objects past said transformer.

5. A sensor as recited in claim 1 wherein:

said first and second frequency components differ from each other by at least 2 octaves.

6. A sensor as recited in claim 1 wherein:

said first frequency component is within one octave of one hundred kiloHertz.

7. A sensor as recited in claim 1 wherein:

said second frequency component is within one octave of 1.5 kiloHertz.

8. A sensor as recited in claim 1 wherein:

said second frequency component is an integer submultiple of said first frequency component.

9. A sensor as recited in claim 1 wherein said signal generating means excites said primary winding with a signal which simultaneously contains said two distinct first and second frequency components.

10. A sensor for identifying members of a predetermined set of metallic objects, each object of said predetermined set of objects being characterized by a predetermined metallic content and a predetermined geometry comprising in combination:

a transformer coil having a primary winding and a secondary winding;

moving means for causing relative movement of members of said predetermined set of metallic objects, one at a time, and said transformer past each other at substantially a predetermined constant velocity;

signal generating means for exciting said primary winding with an electrical signal having at least two distinct first and second frequency components;

signal processing means connected to said second winding for processing output signals from said secondary winding into a first signature signal responsive to said first frequency component in said output signals and a second signature signal responsive to said second frequency component in said output signals;

said signal processing means including means for rectifying said output signals from said secondary winding containing said first frequency component to provide a first rectified output signal, holding means for detecting and storing a first peak value of said first rectified output signal, and width measuring means for measuring a first time period during which said first rectified output signal has a magnitude exceeding a first predetermined magnitude and for providing a first width value in response thereto, wherein said first signature signal comprises said first peak value and said first width value;

storage means for storing a set of object identification signal conditions having at least one member corresponding to each member of said predetermined set of objects and for storing a plurality of stored first and second signature values corresponding to said first and second signature signals, respectively, for each member of said predetermined set of objects;

means connected to said signal processing means for providing one of said object identification output signal conditions in response to said first signature signal and said second signature signal;

control means for selectively and alternately causing said sensor to operate in a calibration mode of operation and to operate in an identification mode of operation, said control means including selectively operable input means for providing a plurality of object identification signals to said storage means;

said calibration mode of operation being one in which said control means responds to said first and second signature signals and one of said object identification signals corresponding to a particular selected one member of said set of objects to provide said stored first and second signature values, corresponding to said particular selected one member, to said storage means for storage therein; and said identification mode of operation being one in which said control means responds to said first and second signature signals and said plurality of stored first and second signature values to provide said object identification output signal conditions.

11. A sensor as recited in claim 10 wherein:

said signal processing means includes means for rectifying said output signals from said secondary winding containing said second frequency component to provide a second rectified output signal, said holding means is responsive to said second rectified output signal to detect and store a second peak value of said second rectified output signals; and said second signature signal comprises said second peak value.

12. A sensor as recited in claim 10 wherein:

said first and second frequency components differ from each other by at least 2 octaves.

13. A sensor as recited in claim 10 wherein:

said first frequency component is within one octave of one hundred kiloHertz.

14. A sensor as recited in claim 10 wherein:

said second frequency component is within one octave of 1.5 kiloHertz.

15. A sensor as recited in claim 10 wherein:

said second frequency component is an integer submultiple of said first frequency component.

16. A sensor as recited in claim 10 wherein said signal generating means excites said primary winding with a signal which simultaneously contains said two distinct first and second frequency components.

17. A transformer for use in a sensor for identifying metallic objects comprising:

a non-ferromagnetic bobbin characterized by a longitudinal axis and a rectangular geometry in cross sections perpendicular to said longitudinal axis;

means defining at least four coil positions, comprising a first coil position, a second coil position, a third coil position, and a fourth coil position lying in planes perpendicular to said longitudinal axis and being disposed along said longitudinal axis at respectively increasing distances from a predetermined end of said bobbin;

a primary winding comprising a first coil and a second coil connected in series with said first coil to form a two terminal connection to said primary winding;

a secondary winding comprising a third coil and a fourth coil connected in series at a connection point;

means connecting said connection point to one terminal of said two terminal connection to said primary winding;

wherein said first coil is located at said second coil position, said second coil is located at said third coil position, said third coil is located at said first coil position, and said fourth coil is located at said fourth coil position.

18. A transformer as recited in claim 17, further comprising:

means defining an elongated bore hole substantially aligned with said longitudinal axis;

a slug of ferromagnetic material sized to fit within said elongated bore hole; and adjusting means for selectively positioning said slug at positions within said elongated bore hole between said second coil position and said third coil position.

19. A transformer as recited in claim 18 wherein:

said slug of ferromagnetic material is disposed within a non-ferromagnetic carrier having a threaded outer surface; and said adjusting means comprises helical threads disposed on the inner wall of said bore hole.

20. A sensor for identifying members of a predetermined set of metallic objects, each object of said predetermined set of objects being characterized by a predetermined metallic content and a predetermined geometry comprising in combination:

a transformer coil having a primary winding and a secondary winding;

moving means for causing relative movement of members of said predetermined set of metallic objects, one at a time, and said transformer past each other at substantially a predetermined constant velocity;

signal generating means for exciting said primary winding with an electrical signal having at least two distinct first and second frequency components;

signal processing means connected to said secondary winding for processing output signals from said secondary winding into a first signature signal responsive to said first frequency component in said output signals and a second signature signal responsive to said second frequency component in said output signals;

said signal processing means including means for rectifying said output signals from said secondary winding containing said first frequency component to provide a first rectified output signal, width measuring means for measuring a first time period during which said first rectified output signal has a magnitude exceeding a first predetermined magnitude and for providing a first width value in response thereto, and wherein said first signature signal comprises said first width value;

means defining a predetermined set of object identification output signals having at least one member corresponding to each member of said predetermined set of objects and at least one member corresponding to an unknown object; and means connected to said signal processing means for providing one of said object identification output signal conditions in response to said first signature signal and said second signature signal.

21. A sensor as recited in claim 20 wherein said signal generating means excites said primary winding with a signal which simultaneously contains said two distinct first and second frequency components.

* * * * *